US011128952B2

(12) United States Patent
Huang

(10) Patent No.: US 11,128,952 B2
(45) Date of Patent: Sep. 21, 2021

(54) OMNIDIRECTIONAL LOUDSPEAKER BOX AND MANUFACTURING METHOD THEREFOR

(71) Applicant: TANG BAND IND CO., LTD., Ningbo (CN)

(72) Inventor: Hsin Min Huang, Ningbo (CN)

(73) Assignee: TANG BAND IND CO., LTD., Ningbo (CN)

( * ) Notice: Subject to any disclaimer, the term of this patent is extended or adjusted under 35 U.S.C. 154(b) by 355 days.

(21) Appl. No.: 16/090,581

(22) PCT Filed: Mar. 31, 2017

(86) PCT No.: PCT/CN2017/078953
§ 371 (c)(1),
(2) Date: Dec. 11, 2018

(87) PCT Pub. No.: WO2017/167261
PCT Pub. Date: Oct. 5, 2017

(65) Prior Publication Data

US 2020/0404414 A1 Dec. 24, 2020

(30) Foreign Application Priority Data

Apr. 1, 2016 (CN) ..... 201610206446.9

(51) Int. Cl.
*H04R 1/40* (2006.01)
*H04R 1/28* (2006.01)
*H04R 1/02* (2006.01)

(52) U.S. Cl.
CPC ..... *H04R 1/403* (2013.01); *H04R 1/2873* (2013.01); *H04R 1/02* (2013.01)

(58) Field of Classification Search
CPC .. H04R 1/2834; H04R 7/16; H04R 2201/028; H04R 2307/207
See application file for complete search history.

(56) References Cited

U.S. PATENT DOCUMENTS 5,850,460 A * 12/1998 Tanaka ..... H04R 1/2834 381/186
5,892,184 A * 4/1999 D'Hoogh ..... H04R 1/2834 181/171
7,133,533 B2 * 11/2006 Chick ..... H04R 1/2834 381/349

(Continued)

FOREIGN PATENT DOCUMENTS

WO WO-2008081499 A2 * 7/2008 ..... H04R 1/403
WO WO-2015110038 A1 * 7/2015 ..... H04R 9/043

*Primary Examiner* — Ryan Robinson
(74) *Attorney, Agent, or Firm* — Raymond Y. Chan; David and Raymond Patent Firm

(57) ABSTRACT

An omnidirectional loudspeaker box comprises a plurality of loudspeaker modules uniformly disposed in an annular configuration. Each loudspeaker module comprises one or more active vibration units and one or more passive vibration units. The one or more active vibration units are uniformly disposed in an annular configuration. The one or more passive vibration units are uniformly disposed in an annular configuration. The one or more active vibration units can respond to the input of external signals and drive the one or more passive vibration units to vibrate together, thereby generating improved sound quality and effect.

4 Claims, 19 Drawing Sheets

(56) References Cited

U.S. PATENT DOCUMENTS

| | | | | |
|---|---|---|---|---|
| 7,324,659 | B2 * | 1/2008 | Funahashi | H04R 9/043 381/398 |
| 7,433,485 | B1 * | 10/2008 | Diedrich | H04R 9/06 381/404 |
| 9,462,391 | B2 * | 10/2016 | Johnston | H04R 9/063 |
| 9,467,783 | B2 * | 10/2016 | Bullimore | H04R 9/043 |
| 9,918,166 | B2 * | 3/2018 | Wu | H04R 9/043 |
| 10,757,494 | B2 * | 8/2020 | Lee | H04R 31/006 |
| 2003/0228027 | A1 * | 12/2003 | Czerwinski | H04R 1/26 381/342 |
| 2017/0013365 | A1 * | 1/2017 | Huang | H04R 7/18 |
| 2020/0275210 | A1 * | 8/2020 | Huang | H04R 31/003 |

* cited by examiner

A-A

OMNIDIRECTIONAL LOUDSPEAKER BOX AND MANUFACTURING METHOD THEREFOR

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a speaker box, and more particularly to an omnidirectional loudspeaker box which is capable of evenly producing sounds to the surrounding.

Description of Related Arts

The speaker box devices in the market usually have their speaker systems arranged on the same side of the speaker box body and producing sound from the same side. As a result, listeners located at various directions from a speaker box device will hear somehow different sound from that speaker box device. Practically, it is difficult to achieve a uniformity of sound. In some occasions, such as in a concert, a plurality of speaker box devices is usually arranged around the surrounding of the venue, ensuring the sound transmitted from the surrounding of the venue to the center of the venue, in order to provide an acoustic feast and great experience to the listeners located in various positions of the venue. Such arrangement is widely utilized and is able to provide a better result. Nonetheless, it is somehow troublesome to arrange and install a plurality of speaker box devices respectively. Moreover, all these speaker boxes have to be connected to the same audio source, which requires not only more connecting cables, but also a reasonable arrangement and installation of these cables that consumes a great deal of time and efforts and is uneconomical.

Besides, the speaker box device that has all the speaker systems arranged on the same side of the speaker box body to produce sound through vibration after an audio to signal is input. Nevertheless, if the speaker box device is, in particular, utilized to play low pitch bass in a louder volume, the speaker box itself will intensely vibrate as well and, consequently, leap or displace. Furthermore, such intense vibration may also cause other objects therearound to vibrate and be damaged. For example, if a speaker box and a computer are placed together, the vibration of the speaker box can render the computer to vibrate together, which may cause damage to the computer components, such as the hard drive and motherboard of the computer. Hence, for places that demand high sound quality, such as concert venue, disco hall, and etc., it requires attachment frames or other means to affix the speaker boxes or keep the speaker boxes stable when work. Moreover, in order to reduce the adverse effects caused by vibration and achieve a high quality of bass effect, speaker box devices for playing bass are usually made cumbersome and bulky, which is difficult to transport and carry around. Hence, it requires a speaker box in compact size with improved sound quality and effect, especially bass effect.

In order to solve the above issues of the conventional art, the present inventor has developed an omnidirectional loudspeaker box. The omnidirectional loudspeaker box of the present invention refers to speaker box arrangement(s) that can evenly and uniformly produce sound to the surrounding thereof.

SUMMARY OF THE PRESENT INVENTION

An object of the present invention is to provide an omnidirectional loudspeaker box which is capable of evenly producing sounds to the surrounding.

Another object of the present invention is to provide an omnidirectional loudspeaker box, which is able to evenly produce sounds to the surrounding along all radial directions thereof.

Another object of the present invention is to provide an omnidirectional loudspeaker box, wherein its loudspeaker modules for sounding are integrated, so as to utilize one device to evenly and uniformly produce sound to the surrounding.

Another object of the present invention is to provide an omnidirectional loudspeaker box, wherein a plurality of loudspeaker modules is arranged around a center thereof in such manner that the included angles between every two adjacent loudspeaker modules are the same such that it can produce sound evenly and uniformly to the surrounding.

Another object of the present invention is to provide an omnidirectional loudspeaker box, wherein a plurality of loudspeaker modules is arranged around a center thereof, wherein the included angles between every two adjacent loudspeaker modules are the same, such that the vibration of the loudspeaker modules can be cancelled out and the influences of the vibration of the loudspeaker modules can thus be mutually counter-balanced and eliminated, that substantially reduces the vibration displacement of the entire speaker box and makes the speaker box more steady at work.

Another object of the present invention is to provide an omnidirectional loudspeaker box, wherein a plurality of the loudspeaker modules can share one vibration chamber. Accordingly, when these loudspeaker modules are vibrating and acting on the air in the vibration chamber, their vibration effects brought into the vibration chamber of the speaker box can be mutually counter-balanced, cancelled out and eliminated with one another.

Another object of the present invention is to provide an omnidirectional loudspeaker box, wherein a plurality of the loudspeaker modules is not solely arranged on the same side of the speaker box, but evenly arranged around the periphery of a center thereof, so as to produce an even omnidirectional sound diffusion effect, so as to evenly produce sound to the surrounding.

Another object of the present invention is to provide an omnidirectional loudspeaker box, wherein the distances between the loudspeaker modules and the center of the speaker box are the same, so as to provide the same sound effect to different locations in different directions of the surrounding.

Another object of the present invention is to provide an omnidirectional loudspeaker box, wherein a plurality of the loudspeaker modules is not solely arranged on the same side of the speaker box, but evenly arranged around the periphery of a center of the speaker box, such that vibration caused by the loudspeaker modules can mutually be counteracted and cancelled out.

Another object of the present invention is to provide an omnidirectional loudspeaker box which comprises a plurality of the loudspeaker modules, including at least two active vibration units and at least two passive vibration units, wherein the two active vibration units respond to the audio signal input to vibrate and act on the air in the vibration chamber, so as to cause the air in the vibration chamber to vibrate to drive the passive vibration unit to vibrate simultaneously, so as to produce an improved sound quality and effect, especially for the bass effect.

Another object of the present invention is to provide an omnidirectional loudspeaker box, which comprises a predetermined even number of active vibration units and a predetermined even number of passive vibration units to form the plurality of loudspeaker modules, wherein each active vibration unit of each loudspeaker module has another active vibration unit of another loudspeaker module arranged on its opposite side in a symmetrical manner, and that each passive vibration unit of each loudspeaker module has another passive vibration unit of another loudspeaker module arranged on its opposite side as well, such that the vibration produced can be better counter-balanced and cancelled out.

Another object of the present invention is to provide an omnidirectional loudspeaker box, which comprises four active vibration units and four passive vibration units to the four loudspeaker modules, wherein the four active vibration units respond to the audio signal input to vibrate and act on the air in the common vibration chamber, so as to cause the air in the vibration chamber to vibrate to drive the passive vibration units to vibrate and produce an improved sound quality and effect, especially for the bass effect.

Another object of the present invention is to provide an omnidirectional loudspeaker box, wherein at least a plurality of active vibration units is evenly and uniformly arranged around the center of the speaker box and a plurality of the passive vibration units are evenly and uniformly arranged around the center of the speaker box as well, wherein the active vibration units and the passive vibration units are alternately arranged, i.e. each active vibration unit is arranged between two passive vibration units and each passive vibration unit is arranged between two active vibration units, such that their vibration directions are directing to or from the center of the speaker box when vibrating, that such even, uniform and alternate arrangement avoids the entire box body from deviating to any certain direction or having vibration displacement.

Another object of the present invention is to provide an omnidirectional loudspeaker box, wherein when the active vibration unit vibrates to act on the air in the vibration chamber along a direction, such as pressing the air in the vibration chamber, the pressed air in the vibration chamber will act on the passive vibration unit along another direction, such that the air vibration in the speaker box can be balanced and the entire box body is stabilized accordingly.

Another object of the present invention is to provide an omnidirectional loudspeaker box, wherein the combination of the active vibration unit(s) and the passive vibration unit(s) facilitates the speaker box to achieve a better bass effect, such that the speaker box does not require complicated internal structural design to achieve a better sound quality and effect while having smaller volume and thinner thickness, so as to be easier to store, transport, and carry.

Other advantages and features of the present invention will be revealed through the following description, while they can be achieved through the specified technologies and combinations thereof indicated in the appended claims.

According to the present invention, it provides an omnidirectional loudspeaker box, which comprises a set of loudspeaker modules uniformly disposed in an annular configuration. Each loudspeaker module comprises an active vibration unit and a passive vibration unit. The active vibration units are uniformly disposed in an annular configuration and the passive vibration units are uniformly disposed in an annular configuration. The active vibration units are arranged to respond to an input of external signals and drive the passive vibration units to vibrate together, thereby producing improved sound quality and effect.

According to some embodiments of the present invention, the active vibration units and the passive vibration units are alternately arranged. The active vibration units and the passive vibration units form a series of vibration units evenly and uniformly arranged to surround around a periphery of an omnidirectional loudspeaker box, so as to make an acoustic field produced by the omnidirectional loudspeaker box more evenly and uniformly.

According to some embodiments of the present invention, the quantities of the active vibration unit and the passive vibration unit are both even numbers.

According to some embodiments of the present invention, there are four active vibration units and four passive vibration units provided and configured.

According to some embodiments of the present invention, the quantities of the active vibration unit and the passive vibration unit are both odd numbers.

According to some embodiments of the present invention, there are active vibration units and three passive vibration units provided and configured.

According to some embodiments of the present invention, it further comprises a box body. The loudspeaker modules are arranged in the box body.

According to some embodiments of the present invention, it further comprises an amplifier system. The amplifier system is arranged on a top side of the set of loudspeaker modules.

According to some embodiments of the present invention, it further comprises an energy supply system. The amplifier system is arranged on a bottom side of the set of loudspeaker modules.

According to some embodiments of the present invention, each of the passive vibration units comprises a vibration component, a supporting frame and a suspension edge. The suspension edge has an inner fringe and an outer fringe. The inner fringe of the suspension edge is arranged on an outer edge of the vibration component. The outer fringe of the suspension edge is arranged on an inner edge of the supporting frame, so as to have the suspension edge encirclingly arranged between the vibration component and the supporting frame.

According to some embodiments of the present invention, each of the active vibration units comprises at least a magnetic coil unit, at least a voice coil, at least a vibration unit, at least a frame assembly, at least a suspension edge, and at least a folding elastic-wave member. The voice coil is driven by the magnetic coil unit to move reciprocally. The vibration unit is driven by the voice coil to move reciprocally. The suspension edge is connected with the vibration unit and the frame assembly. The folding elastic-wave member is connected with the suspension edge, the frame assembly, and the vibration unit. The folding elastic-wave member comprises a resilient circular periphery portion and a tubular portion. The tubular portion is extended from the circular periphery portion. The circular periphery portion is connected with the frame assembly.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
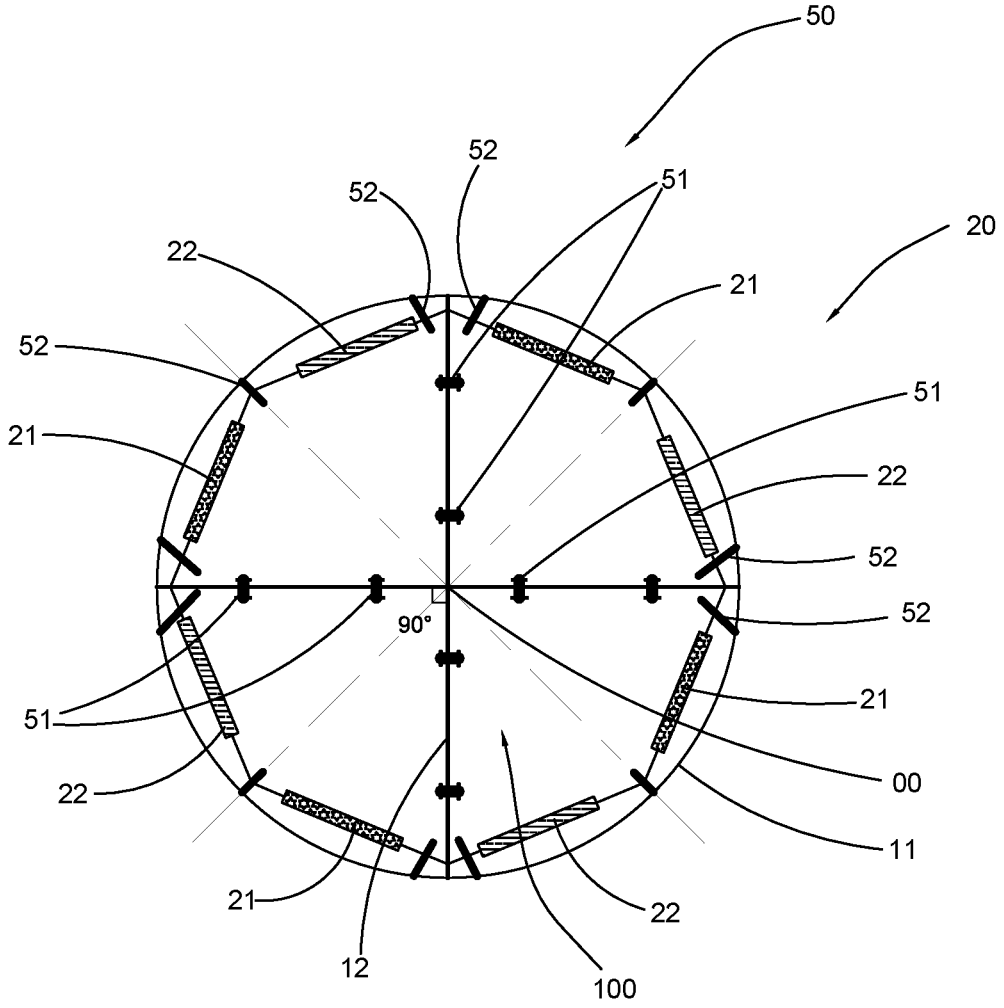
FIG. 1A is a schematic view of an omnidirectional loudspeaker box according to a first preferred embodiment of the present invention.

The following description is disclosed to enable any person skilled in the art to make and use the present invention. Preferred embodiments in the following are examples only and person skilled in the art can come out with other obvious alternatives. The general principles defined in the following description would be applied to other embodiments, alternatives, modifications, equivalents, and applications without departing from the spirit and scope of the present invention.

FIGS. 1A-4 illustrates an omnidirectional loudspeaker box according to a first preferred embodiment of the present invention, which comprises a box body 10 and a plurality of s 20 arranged around the box body 10. The loudspeaker modules 20 are arranged and configured to respond to external audio signal input to vibrate and produce predetermined sound. The box body 10 has a centerline position 00 along an axial thereof. These loudspeaker modules 20 are evenly and uniformly arranged around the centerline position 00 by setting the centerline position 00 as the axis of the loudspeaker module, so as for producing sound toward various directions from the centerline position 00. According to the above first preferred embodiment of the present invention, the quantity of the loudspeaker modules 20 is four. Person skilled in the art should understand that the quantity of four for the loudspeaker modules 20 is just an example rather than limiting the present invention. According to other embodiments of the present invention, the quantity of the loudspeaker modules 20 can be other number, such as six, three, and etc., as long as it can achieve the object of the present invention, that the present invention shall not be limited in this respect. The present invention will be introduced in the following based on the above first preferred embodiment as an example, in which the quantity of the loudspeaker module 20 is embodied as four.

As illustrated in the drawings, the box body 10 has four symmetrical module spaces 100 symmetrically arranged around the centerline position 00 which forms a center of the box body 10. As illustrated in the drawings, each of the module spaces 100 has an included angle of 90°, which means that a total of the included angles of the four module spaces 100 is 360° about the centerline position 00. Hence, the four loudspeaker modules 20 are arranged in the four module spaces 100 respectively and thus closely arranged together in a compact manner to form the omnidirectional loudspeaker box that fully utilizes the space and provides a mutual supporting and anchoring function with each other. Accordingly, having the centerline position 00 as a center, the included angle between each two adjacent loudspeaker modules 20 is 90°. In other words, the four loudspeaker modules 20 are evenly and uniformly distributed to surround around the centerline position 00.

According to the above first preferred embodiment of the present invention, the box body 10 comprises a injected plane net 11 made by plastic injection with original color and a supporting frame 12. The supporting frame 12 is made by injection with high density and stability material. The supporting frame 12 is arranged in the injected plane net 11 to form a plurality of module spaces 100 each having dimension and shape corresponding to the that of the plurality of loudspeaker modules 20 so that the loudspeaker modules 20 are adapted to be fittingly inserted into the module spaces 100 respectively. Referring to FIG. 1A, the loudspeaker modules 20 and the supporting frame 12 are fastened with each other so as to affix the loudspeaker modules 20 steadily in their predetermined positions.

Referring to the drawings, each of the loudspeaker modules 20 comprises an active vibration unit 21, a passive vibration unit 22 and a module frame 23. The module frame 23 is provided and arranged for installing, affixing, and protecting the active vibration unit 21 and the passive vibration unit 22. According to the above first preferred embodiment of the present invention, the module frame 23 is formed by molding through an upper mold and a lower mold.

Figure 3A:
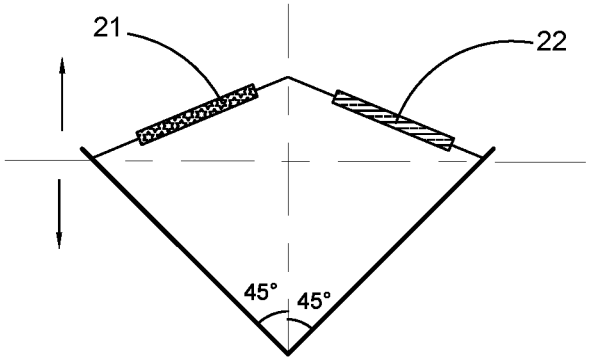
FIGS. 3A and 3B are schematic views illustrating a loudspeaker module of the omnidirectional loudspeaker box according to the above first preferred embodiment of the present invention.
Figure 3B:
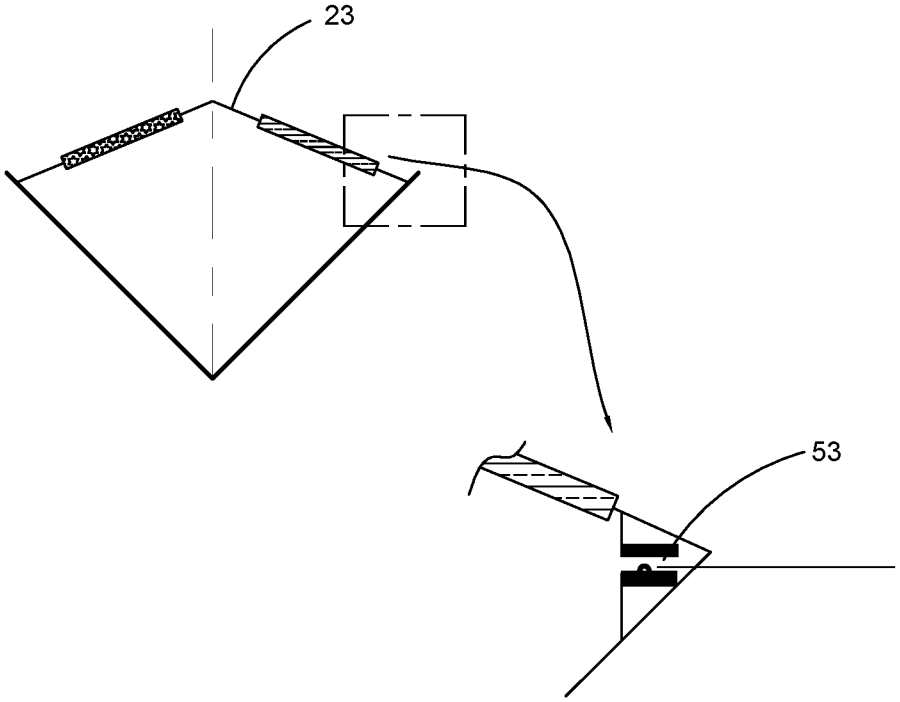
Figure 4:
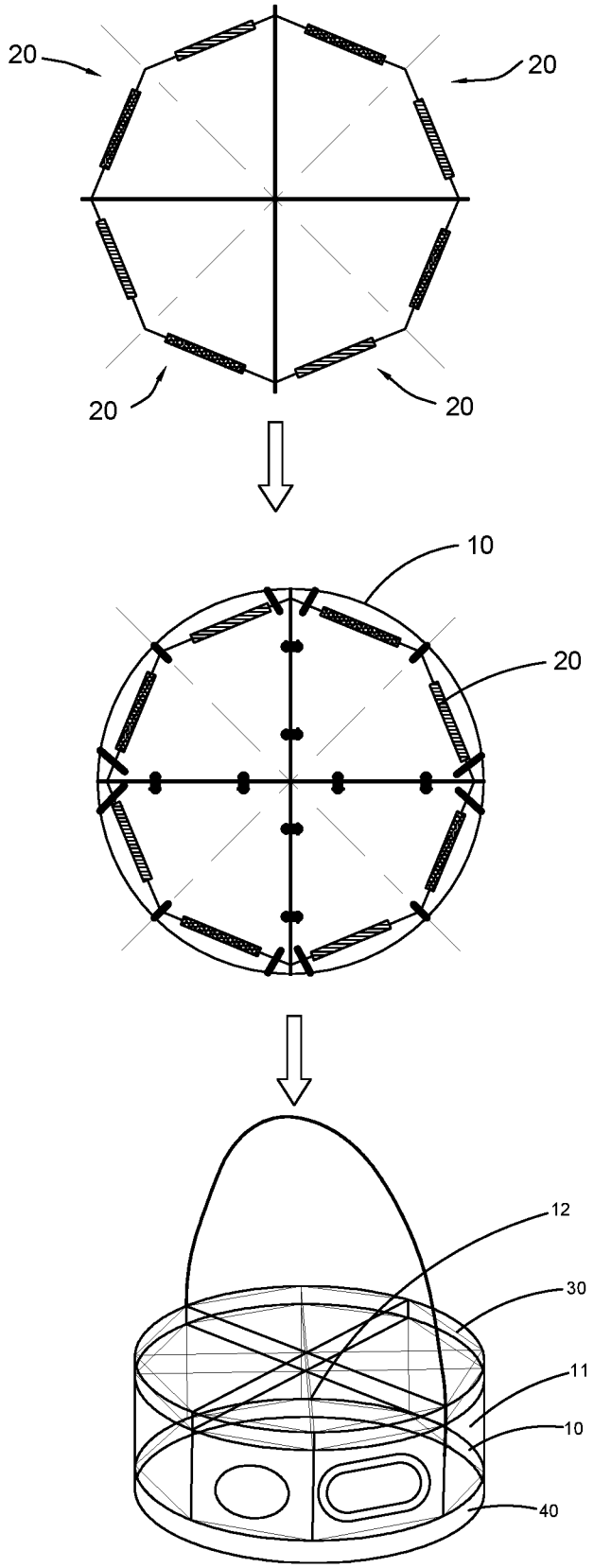
FIG. 4 illustrates the assembling of the omnidirectional loudspeaker box according to the above first preferred embodiment of the present invention.

Referring to FIG. 3B, a connecting means 50 is provided which comprises a series of connecting components 53, adapted for connecting the turnings of the module frames 23 of the loudspeaker modules 20. It is worth mentioning that according to the above first preferred embodiment of the present invention the connecting component 53 is connected through ultrasonic welding.

As illustrated in the drawings, each of the loudspeaker modules 20 comprises the active vibration unit 21 and the passive vibration unit 22. In other words, the omnidirectional loudspeaker box according to the above first embodiment of the present invention comprises four active vibration units 21 and four passive vibration units 22, so that there are eight vibration units in total. The four active vibration units 21 are evenly arranged around the centerline position 00. While having the centerline position 00 as the center of the omnidirectional loudspeaker box, the included angle between each two of the active vibration units 21 is 90°. Also, the four passive vibration units 22 are evenly arranged around the centerline position 00. While having the centerline position 00 as the center of the omnidirectional loudspeaker box, the included angle between each two of the passive vibration units 22 is 90°.

According to the above first embodiment of the present invention, the four active vibration units 21 and the four passive vibration units are evenly, uniformly 22 are alternately arranged around the centerline position 00, wherein, in particular, two sides of each of the active vibration units 21 are each arranged with one of the passive vibration units 22 adjacently, and that two sides of each of the passive vibration units 22 are each arranged with one of the active vibration units 21 adjacently. While having the centerline position 00 as the center, the included angle between each of the active vibration units 21 and its adjacent passive vibration unit 22 is 45°. Similarly, the included angle between each of the passive vibration units 22 and its adjacent active vibration unit 21 is 45° too.

In view of above, the active vibration units 21 and the passive vibration units 22 are evenly and uniformly arranged around the centerline position 00, such that the eight active and passive vibration units 21 and 22 are surrounding the centerline position 00 to produce sound towards eight directions respectively, such that the omnidirectional loudspeaker box can produce sound evenly in all directions around the surrounding thereof and make its acoustic field more even and uniform. In other words, the omnidirectional loudspeaker box regards the centerline position 00 as the center to evenly, uniformly, and radially produce sound to the surrounding thereof.

It is worth mentioning that, as mentioned above, the quantity of the loudspeaker module 20 may vary. According to other embodiment of the present invention, when the quantity of the loudspeaker module 20 is N, correspondingly, the quantity of the module space 100 is N, wherein each module space 100 has an included angle of (360/N)°, and correspondingly, while making the centerline position 00 as a center, the included angle between each two of the active vibration units 21 is (360/N)° and the included angle between each two of the passive vibration units 22 is (360/N)° as well. Correspondingly, the included angle between each of the active vibration units 21 and its adjacent passive vibration unit 22 is (360/2N)°. If there are N active vibration units 21 and N passive vibration units 22 evenly and uniformly arranged around the centerline position 00, there are 2N vibration units 21 and 22 producing sound toward 2N directions around the centerline position 00, such that the omnidirectional loudspeaker box can evenly and uniformly produce sound therearound and make its acoustic field more even and uniform.

It is worth mentioning that such evenly and uniformly surrounding arrangement is able to not only benefit in producing even and uniform sound, but also keep the box body 10 steady. Specifically, the plurality of the active vibration units 21 vibrate outwardly, symmetrically and simultaneously during the sounding operation of the omnidirectional loudspeaker box. Such evenly and symmetrically surrounding arrangement allows the vibration of the active vibration units 21 to be counter-balanced and cancelled out with each other. Similarly, the plurality of the passive vibration units 22 vibrate inwardly, symmetrically and simultaneously during the sounding operation of the omnidirectional loudspeaker box. Such evenly and symmetrically surrounding arrangement allows the vibration of the passive vibration units 22 to be counter-balanced and cancelled out with each other, so as to ensuring the omnidirectional loudspeaker box to work in abe more steady manner.

It is worth mentioning that, according to the above first preferred embodiment of the present invention, the quantities of the active vibration unit 21 and the passive vibration unit 22 are both embodied as four, which is an even number. Therefore, each active vibration unit 21 that is arranged in the above mentioned even and uniform manner will have another active vibration units 21 arranged at a relative and symmetrical position in the opposite direction thereof. Each passive vibration unit 22 has another passive vibration units 22 arranged at a relative and symmetrical position in the opposite direction thereof too. Even number of the active vibration units 21 are centrosymmetrically arranged on the box body 10. Even number of the passive vibration units 22 are centrosymmetrically arranged on the box body 10. More specifically, each pair of these active vibration units 21 are centrosymmetrically arranged on the box body 10 in opposing directions and each pair of the passive vibration units 22 are centrosymmetrically arranged on the box body 10 in opposing directions as well, i.e. each opposing pair of the active vibration units 21 and each opposing pair of the passive vibration units 22 are arranged back-to-back symmetrically in opposing directions, as shown in FIG. 1A. It is worth mentioning that, according to the above first preferred embodiment of the present invention, the omnidirectional loudspeaker box comprises four active vibration units 21 and four passive vibration units 22. The active vibration units 21 are connected with an external sound source so as to respond to the audio signal input from the external sound source to vibrate and produce sound. Hence, these active vibration units 21 are mutually centrosymmetrically arranged, such that as the active vibration units 21 vibrate, each opposing pair of the active vibration units are respectively vibrating toward opposite directions. As illustrated in the drawings, during a vibration process, the vibration directions of the four active vibration units 21 are toward the outside, such that each active vibration unit 21 and another opposing active vibration unit 21 are arranged on the opposite sides producing vibration in two opposing directions towards outside respectively. In other words, the vibration directions of every two corresponding and opposing active vibration units 21 are exactly opposite, so that the entire box body 10 will not bear any overall acting force toward a specific direction due to the vibration that substantially keeps the box body 10 staying in a balanced and steady condition. Similarly, during a vibration process, the vibration directions of four passive vibration units 22 are also toward the outside, such that each passive vibration unit 22 and another opposing passive vibration unit 22 are arranged on the opposite sides producing vibration in two opposing directions towards outside respectively. In other words, the vibration directions of every two corresponding and opposing passive vibration units 22 are exactly opposite, so that the entire box body 10 will not bear any overall acting force toward a specific direction due to the vibration that substantially keeps the box body 10 staying in a balanced and steady condition.

It is further worth mentioning that, according to the above first preferred embodiment of the present invention, the four active vibration units 21 are utilized to drive the four passive vibration units 22 to generate vibrations. In other words, the four passive vibration units 22 are not directly connected to the external audio source. Instead, their vibration results from the vibration of the four active vibration units 21. More specifically, when the four active vibration units 21 are vibrating, the air in the box body 10 are pressed correspondingly, such that the vibration of the air in the box body 10 acts on the four passive vibration units 22 and drive the four passive vibration units 22 to vibrate consequently and produce sound as a result.

Because the four passive vibration units 22 also produce sound at the same time, the sound quality and effect of the omnidirectional loudspeaker box can be significantly enhanced, especially for the bass effect thereof. Accordingly, the speaker box of the omnidirectional loudspeaker box does not have to be bulky or cumbersome. Hence, by matching and coordinating of the pairs of active vibrations units 21 and passive vibration units 22 in the omnidirectional loudspeaker box of the present invention, it can produce ideal sound quality and effect, especially for the sound quality and effect of bass, such that the omnidirectional loudspeaker box can be made in more compact size and easy to carry and transport.

It is worth mentioning that one active vibration unit 21 can be used to drive or bring one passive vibration unit 22 to vibrate while the active vibration unit 21 and the passive vibration unit 22 both share a common air vibration chamber. According to the above first preferred embodiment of the present invention, the box body 10 forms a vibration chamber 100 therein, wherein the active vibration units 21 and the passive vibration units 22 are respectively arranged around the vibration chamber 100. In other words, these active vibration units 21 and passive vibration units 22 utilize and share the same air vibration chamber 100.

As illustrated in the drawings, when the vibration directions of the four active vibration units are toward the outside, the four passive vibration units 22 will correspondingly vibrate toward the inside due to the influence of the constant amount of air inside the vibration chamber 100. In other words, the air retained in the vibration chamber 100 bears balanced acting forces from all around, rather than receiving any specific acting force in a specific direction significantly acting against the box body 10 that may result in displacement of the box body 10. In other words, these active vibration units 21 and passive vibration units 22 agitate the air in the vibration chamber 100, but the entire box body 10 will not vibrate and generate noise. Rather, the sound quality achieved becomes more pure and clean.

In other words, when the speaker box of the present invention is working, its vibration can be counter-balanced and cancelled out mutually within the box body 10 itself, so as to ensure the speaker box staying balanced and steady. As a result, the entire box body 10 will not produce relatively large vibration on its working table.

According to the above first preferred embodiment, the box body 10 has eight mounting holes respectively formed in eight sides of the box body 10 for mounting the four active vibration units 21 and the four passive vibration units 22 respectively in position. Correspondingly, the positions of the mounting holes are centrosymmetrically arranged.

It is worth mentioning that the speaker box 10 further comprises four amplifier units 15, which are respectively arranged on the top sides of the four loudspeaker modules 20 for respectively being connected with the four active vibration units 21 and providing audio signal input to these four active vibration units 21.

The four active vibration units 21 can be embodied as various structures of speaker, as long as they are able to respond to audio signal input and vibrate to produce sound. More specifically, according to the present invention, each of the active vibration units 21 comprises a major vibration component, which can be a speaker diaphragm, drum paper, or etc. Besides, each of the active vibration units 21 also comprises a suspension edge arranged around the major vibration component and necessary components, such as voice coil, magnetic coil system, and etc. Each of the active vibration units 21 further comprises a mounting frame adapted for mounting on the respective mounting hole of the box body 10, so as to be hermetically mounted to the box body 10. It is worth mentioning that the suspension edge may also be mounted on the surface of the respective mounting hole of the box body 10.

When there is audio signal input, the voice coil will reciprocally move under the effect of the magnetic field of the magnetic coil system, so as to drive the major vibration component to produce sound. Meanwhile, the air in the vibration chamber 100 will be pressed and bring the passive vibration units 22 to vibrate and therefore produce auxiliary sound effect.

It is worth mentioning that the magnetic coil system is connected to an affixing frame and the affixing frame is assembled with the mounting frame, such that the whole active vibration unit 21 can be formed. The assembling mode of the affixing frame and the mounting frame can be buckling connection, or by means of matched lock components or other modes, such as heat pressing, ultrasonic, heat-melt, and etc.

Each of the passive vibration units 22 comprises a vibration block 221 positioned in the middle and an elastic suspension edge 222 provided around the vibration block 221. The elastic suspension edge 222 may directly be arranged on an inner surface of the respective mounting hole of the box body 10. According to the present embodiment, the passive vibration unit 22 further comprises a position frame 223. The position frame 223 is mounted at the respective mounting hole of the box body 10 so as to be hermetically mounted to the box body 10.

Figure 1B:
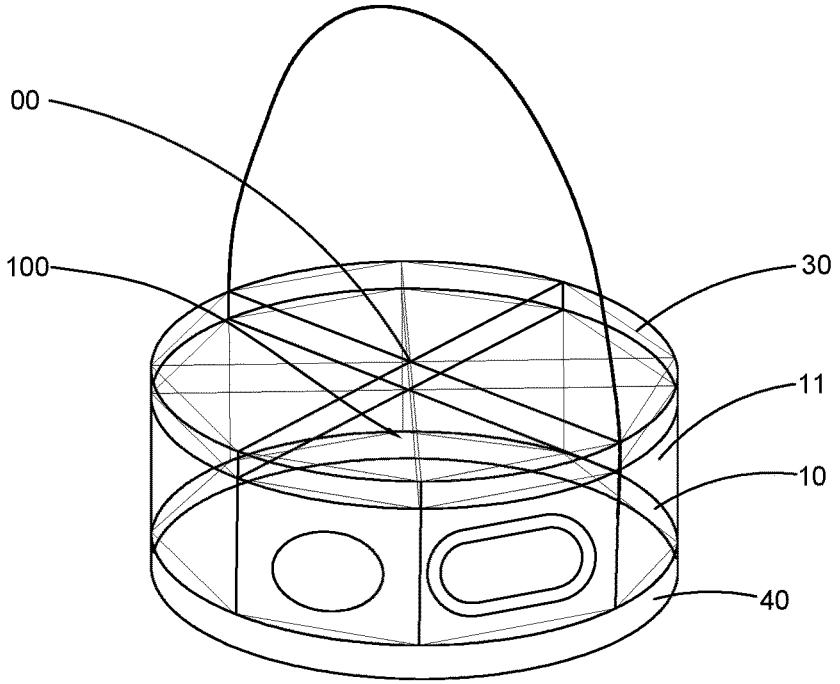
FIG. 1B is a perspective view of the omnidirectional loudspeaker box according to the above first preferred embodiment of the present invention.
Figure 2:
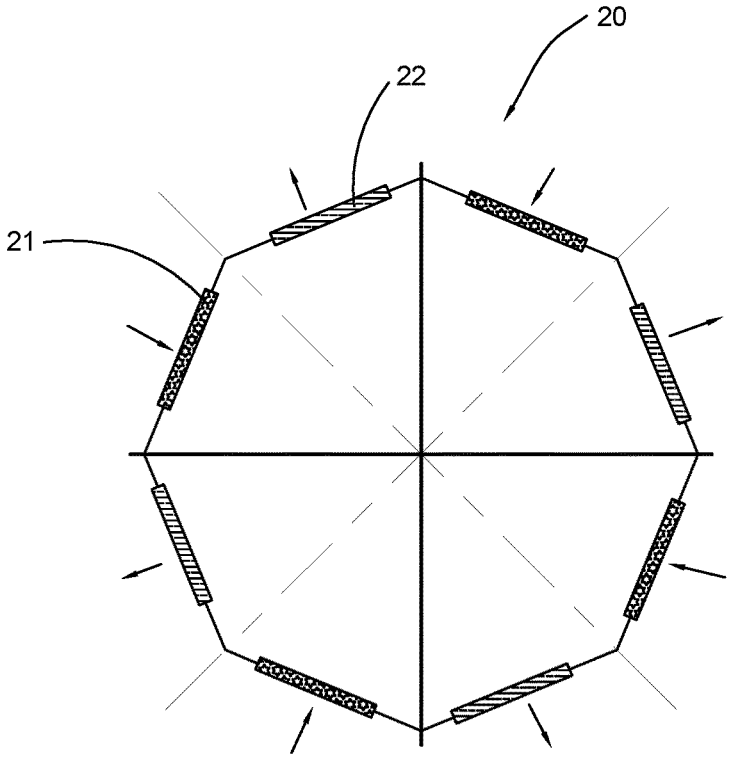
FIG. 2 is a schematic view illustrating the vibration directions of a plurality of vibration units of the omnidirectional loudspeaker box according to the above first preferred embodiment of the present invention.

The omnidirectional loudspeaker box of the present invention further comprises an energy supply system 40. Referring to FIG. 1B, according to the above first preferred embodiment of the present invention, the energy supply system 40 is arranged on a bottom side of the loudspeaker module 20, which is the bottom side of the entire speaker box, so as to serve to stabilize the speaker box.

Hence, the speaker box of the present invention can be data communicated with an external audio device, such as a laptop and etc., via a wired or wireless connection. When the user demands an audio file in the laptop to be played, the audio information will be transmitted to the omnidirectional loudspeaker box and the omnidirectional loudspeaker box will play the audio file upon the reception of the audio signal. Besides, since the omnidirectional loudspeaker box of the present invention is small and compact, it is easy to be carried with and utilized; thanks to the matching and coordination of the active vibration units 21 and the passive vibration units 22, the sound quality and effect thereof can also be well guaranteed.

Referring to FIG. 1A, the omnidirectional loudspeaker box further comprises a plurality of connecting elements 50, adapted for firmly connecting all components of the speaker box together, so as to construct a steady structure for the omnidirectional loudspeaker box. In particular, the connecting elements 50 include a plurality of connecting members 51 for connecting adjacent loudspeaker modules 20 and a plurality of holding members 52 for holding and affixing the loudspeaker modules 20 in the box body 10. According to the above first preferred embodiment of the present invention, each of the holding members 52 is embodied as a plug.

Figure 5A:
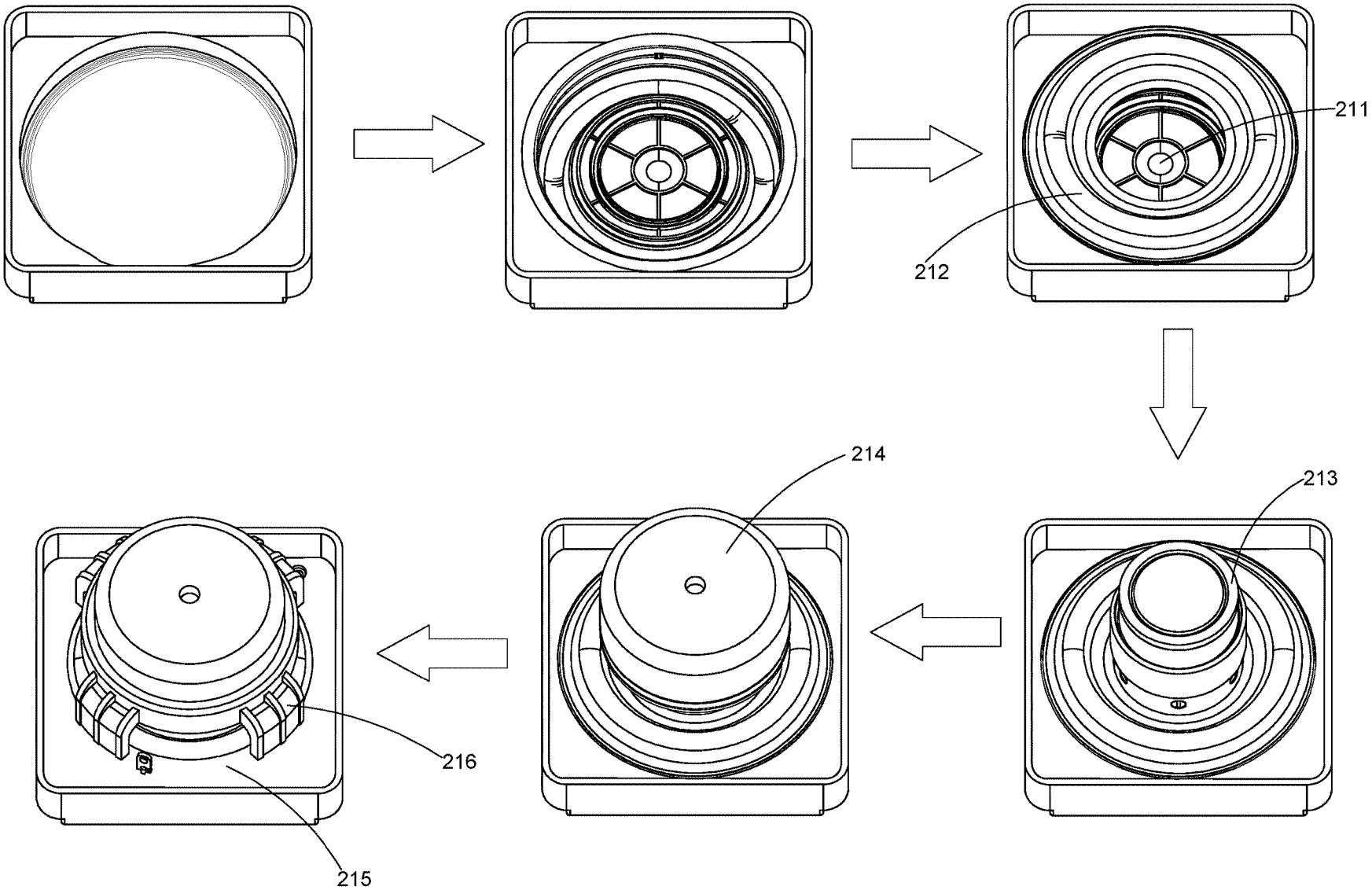
FIGS. 5A and 5B illustrates an active vibration unit and a passive vibration unit of the omnidirectional loudspeaker box according to the above first preferred embodiment of the present invention.
Figure 5B:
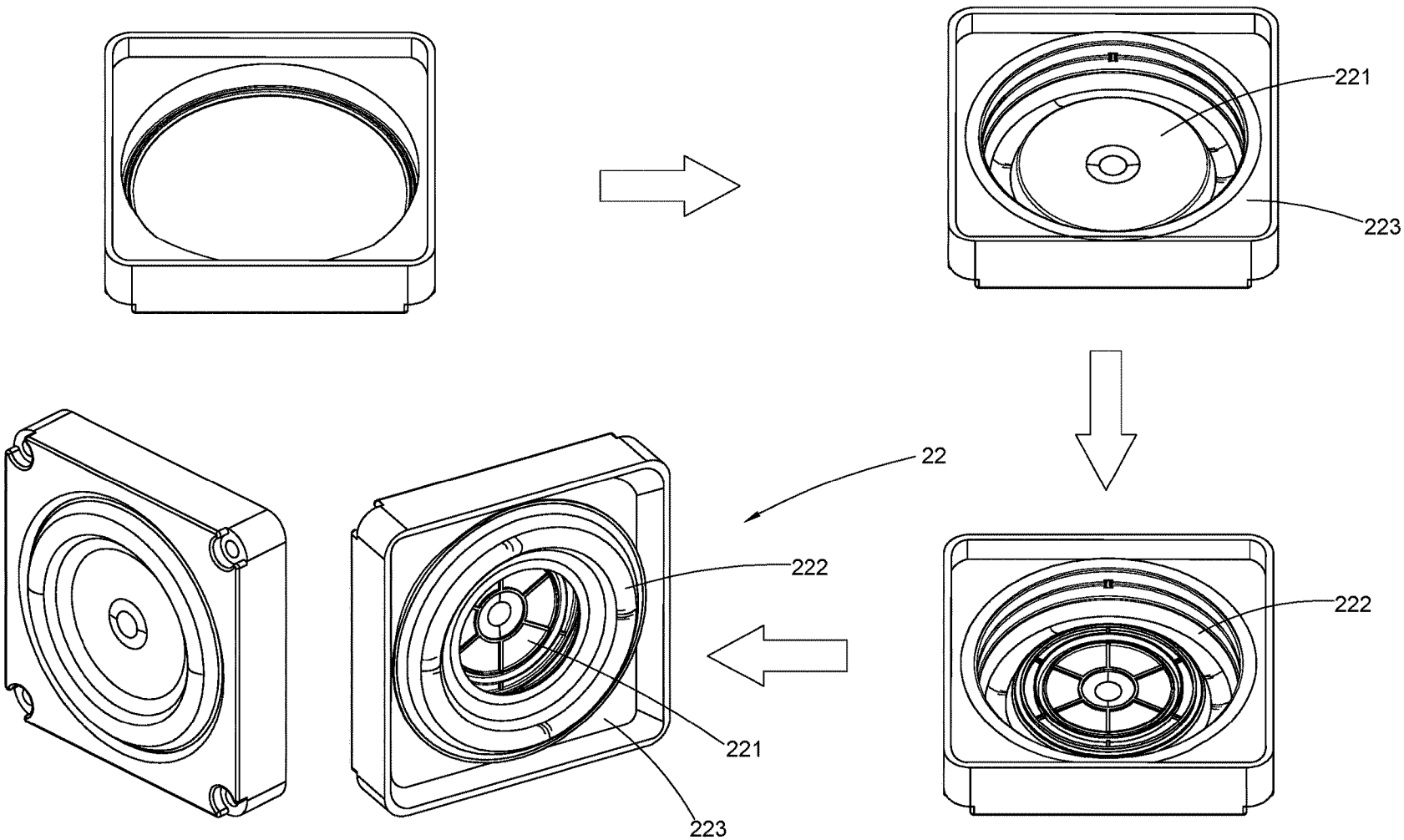

It is worth mentioning that, referring to FIGS. 5A and 5B, the present invention also provides a production process of a speaker box of the omnidirectional loudspeaker box. According to the present invention, the active vibration units 21 and the passive vibration units 22 are made first and then the active vibration units 21 and the passive vibration units 22 are integrally assembled with the box body 10.

The process of manufacturing the active vibration unit 21 may comprise the following steps:

Provide a main vibration component, such as a vibration diaphragm made of alloy material or other rigid material, and a mounting frame in the rubber injection mold.

Cover, enclose and warp up the vibration diaphragm with rubber to form the main vibration component and form at least a suspension edge between the mounting frame and the main vibration component, by means of embedding and injection molding through an injection molding machine.

Connect a voice coil with the main vibration component and form a magnetic coil unit with an affixing frame from the magnetic coil system by molding the channel bar, the magnet, the pole pieces, and etc. to form an integral structure by means of plastic injection molding.

Then, couple the magnetic coil unit and the mounting frame together through fastening, heat pressing fusion, ultrasonic welding, heat-melting, or other method to form the integral active vibration unit 21.

Similarly, the process of manufacturing the passive vibration unit 22 comprises the following steps:

Provide a vibration block 221 (or a vibration diaphragm made of rigid material) and a position frame 223 in the rubber injection mold.

Cover, enclose, and wrap up the vibration diaphragm by rubber to form the vibration block 221 and form at least an elastic suspension edge 222 between the position frame 223 and the vibration block 221.

The box body 10 is made in cylinder-shape and has a plurality of active vibration unit mounting holes and passive vibration unit mounting holes which are evenly and uniformly distributed and arranged around a center of the box body 10. The active vibration units 21 and the passive vibration units 22 are respectively mounted at these active vibration unit mounting holes and passive vibration unit mounting holes respectively through necessary mounting components, so as to form the speaker box of the omnidirectional loudspeaker box. The active and passive vibration units are evenly and uniformly arranged around the center of the box body 10, which not only reduces or even eliminates the overall vibration of the speaker box, but also enhances the bass effect and appearance thereof. It is worth mentioning that, as mentioned above, the active vibration unit 21 may also be a conventional speaker.

It is worth mentioning that the suspension edge of the active vibration unit 21 is made to have a wave form cross section and formed around the main vibration component and the elastic suspension edge 222 of the passive vibration unit 22 is made to have a wave form cross section and formed around the vibration block 221, so as to avoid the vibration of the main vibration component and the vibration block 221 from intensely pulling the corresponding mounting frame and position frame 223 that may cause damage.

The action vibration unit 21 is the main vibration component of the speaker box, wherein its suspension edge, the vibration block 222 of the passive vibration unit 22 and the elastic suspension edge 222 can also be made in various shapes. According to the above first preferred embodiment, the suspension edge and the main vibration component of the active vibration unit 21 can be in round shape, and that the vibration block 221 and the elastic suspension edge 222 of the passive vibration unit 22 may also be made in round shape. Certainly, it may be in other shape, such as rectangle and etc., or other shape, such as polygon, oval, and etc.

The omnidirectional loudspeaker box further comprises an amplifier system installed on the speaker box during the production process thereof. The amplifier system 30 is electrically connected with each of the active vibration units 21 and has one or more wireless network modules, such as Bluetooth module, NFC module, WIFI module, and etc., such that the omnidirectional loudspeaker box can exchange data and information with other sound source devices or speaker devices through wireless connection. When the sound source device sends a sound signal and transmits data to the omnidirectional loudspeaker box, the omnidirectional loudspeaker box may play the audio according to the request. It is worth mentioning that the powers of these active vibration units 21 are the same.

The amplifier system 30 of the speaker box may also comprise a connection interface element for connecting with other audio source devices or speaker devices and data exchanging through wired connection. For example, it may respond to the demand of wired connected devices, such as computer, cellphone, PDA, MP3, MP4, MP5, other speaker device with audio source, and etc., to play music or other sounds. Referring to FIG. 1B, the amplifier system 30 is arranged on the top side of the loudspeaker module 20, which is the top side of the entire speaker box and is convenient in connecting with other devices. There can be flexible silicone mask arranged around the amplifier system 30.

Figure 6:
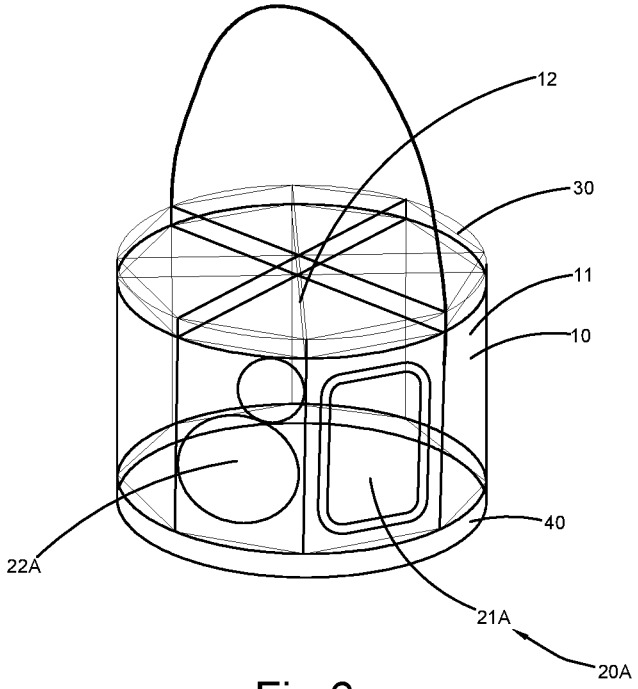
FIG. 6 is a perspective view illustrating an omnidirectional loudspeaker box according to an alternative mode of the above first preferred embodiment of the present invention.

FIG. 6 illustrates an omnidirectional loudspeaker box according to an alternative mode of the above first preferred embodiment of the present invention. As illustrated, a loudspeaker module, according to the alternative mode, comprises two active vibration units 21A and a passive vibration unit 22A. It is different from the above first preferred embodiment that has one active vibration unit 21 driving one corresponding passive vibration unit 22 to vibrate that, according to the alternative mode of the embodiment, it has two active vibration units 21A arranged to drive one passive vibration unit 22A to vibrate. It is worth mentioning that, according to other embodiment of the present invention, it may also have two active vibration units 21A driving one passive vibration unit 22A to vibrate or have only one active vibration unit 21A driving multiple passive vibration units 22A to vibrate. As long as it can achieve the object of the present invention, the present invention shall not be limited in this respect.

In view of above and as illustrated in the appended drawings, according to the above first preferred embodiment of the present invention, sound produced by the omnidirectional loudspeaker box is radiated in all directions to the environment around the center thereof, rather than toward a single direction or two opposite directions like the speaker box modules of the conventional speaker box. Such evenly and uniformly sounding arrangement produces better sound effect for the omnidirectional loudspeaker.

Figure 7:
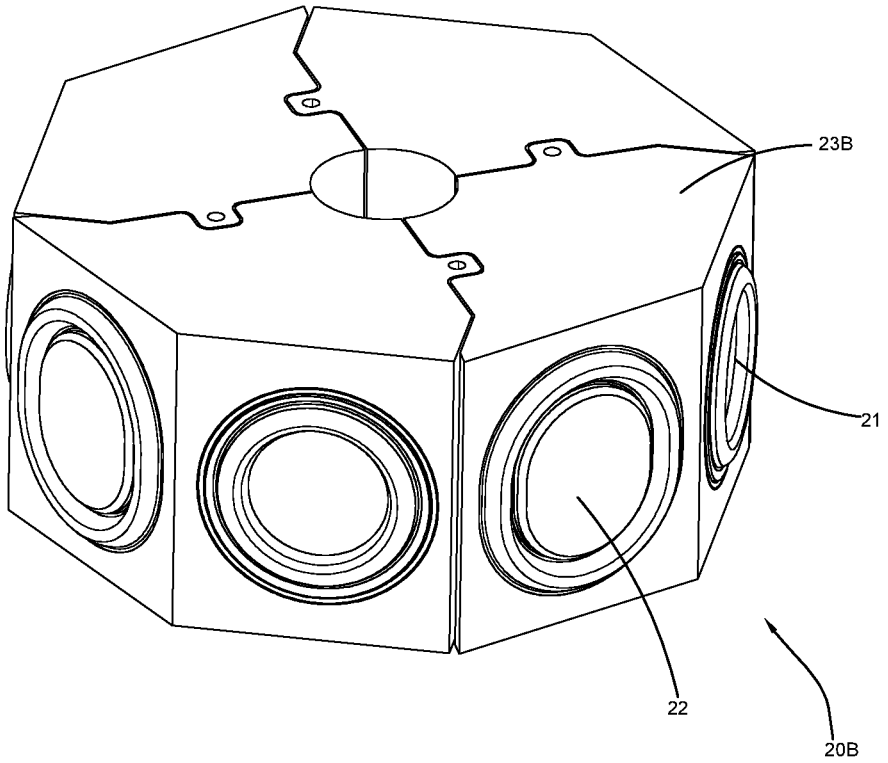
FIG. 7 is a perspective view illustrating an omnidirectional loudspeaker box according to another alternative mode of the above first preferred embodiment of the present invention.

FIG. 7 illustrates an omnidirectional loudspeaker box according to an alternative mode of the above first preferred embodiment of the present invention. According to the alternative mode of the embodiment, the omnidirectional loudspeaker box comprises a set of loudspeaker modules 20B evenly and uniformly arranged around a center of the omnidirectional loudspeaker box. It is different from the above first preferred embodiment in that the loudspeaker modules 20B are firmly connected with one another, so as to form an equilateral polygon speaker box. According to the alternative mode of the embodiment of the present invention, the omnidirectional loudspeaker box is in octagon-shape.

Figure 8:
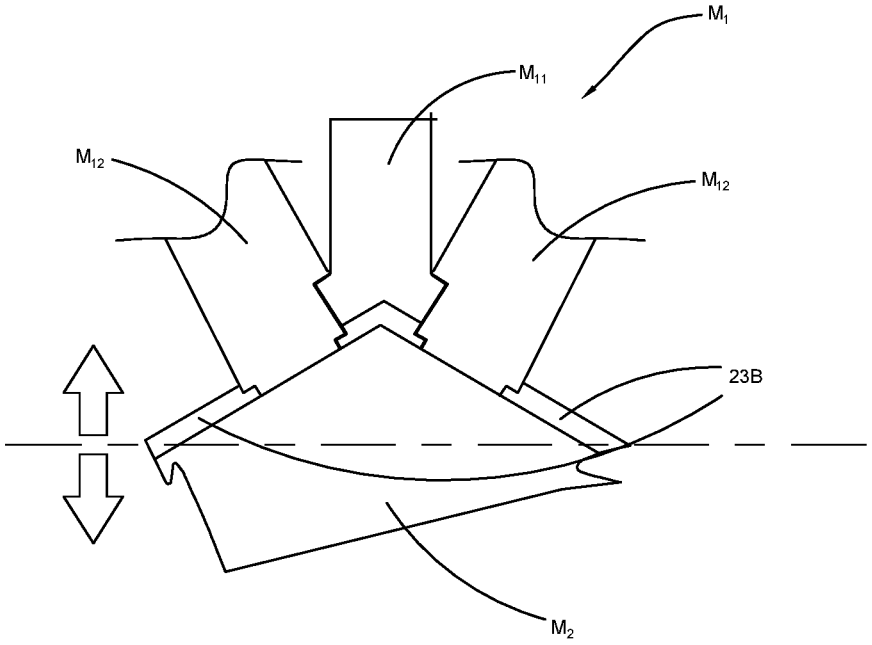
FIG. 8 is a schematic view illustrating the production process of a module frame of the omnidirectional loudspeaker box according to the above first preferred embodiment of the present invention.

Referring to the FIGS. 7 and 8, each of the loudspeaker modules 20B comprises an active vibration unit 21, a passive vibration unit 22 and a module frame 23B. The module frame 23B is provided and arranged for installing, affixing, and protecting the active vibration unit 21 and the passive vibration unit 22. According to the above first preferred embodiment of the present invention, the module frame 23B is formed by molding through two molds M1 and M2.

FIG. 8 is a schematic view illustrating the production process of a module frame 23B of the omnidirectional loudspeaker box according to the alternative mode of the above first preferred embodiment of the present invention. Referring to FIG. 8, in order to form the shape of the module frame 23B, the mold M1 comprises a top mold M11 and a pair of side molds M12 arranged on two sides of the top mold M11. Each of the side molds M12 is used to form the mounting hole for mounting the active vibration unit 21 or the passive vibration unit 22. Referring to FIG. 8, during the opening of the molds, the side molds M12 will be pulled up before pulling up the top mold M11. After the side molds M12 are pulled up, the entire mold M1 will be pulled up as the simple slider way.

Figure 9:
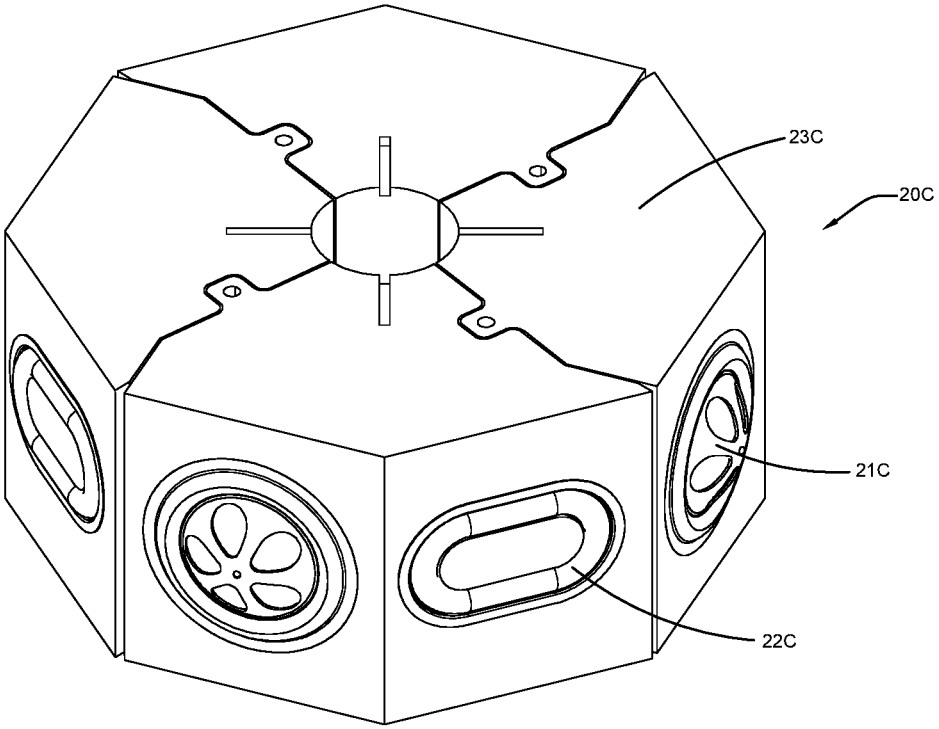
FIG. 9 is a perspective view of an omnidirectional loudspeaker box according to a second preferred embodiment of the present invention.
Figure 10:
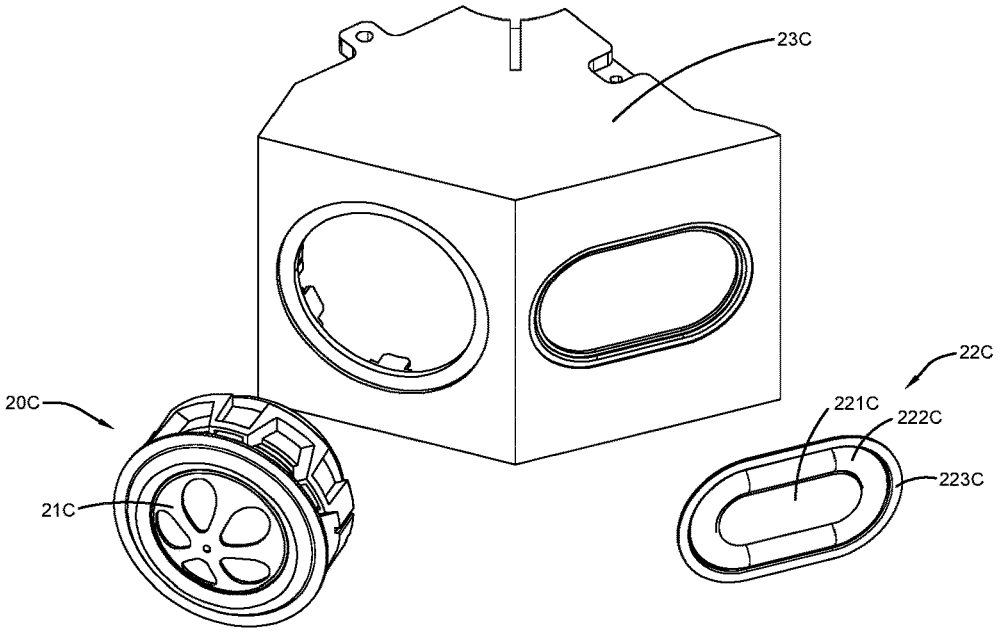
FIG. 10 is an exploded view of the omnidirectional loudspeaker box according to the above second preferred embodiment of the present invention.

FIGS. 9 and 10 illustrate an omnidirectional loudspeaker box according to a second preferred embodiment of the present invention. Referring to FIG. 9, the omnidirectional loudspeaker box comprises a plurality of loudspeaker modules 20C uniformly disposed in an annular configuration.

Figure 11:
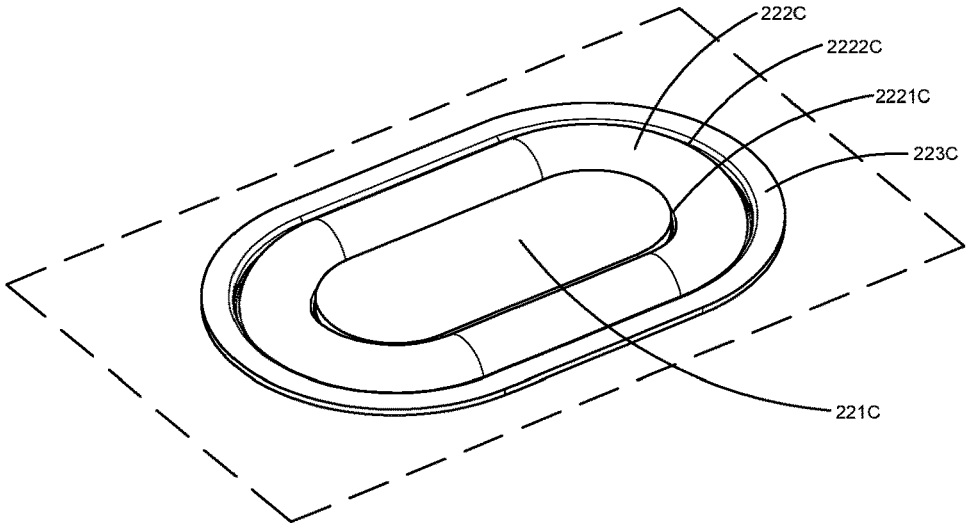
FIG. 11 is a perspective view of a passive vibration unit of the omnidirectional loudspeaker box according to the above second preferred embodiment of the present invention.
Figure 12:
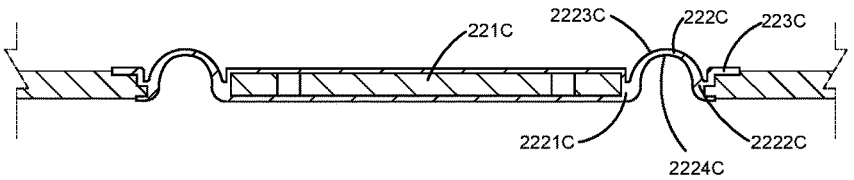
FIG. 12 is a sectional view of the passive vibration unit of the omnidirectional loudspeaker box according to the above second preferred embodiment of the present invention.

Referring to FIGS. 11 and 12, according to the above second preferred embodiment of the present invention, each of the loudspeaker modules 20C comprises an active vibration unit 21C, at least a passive vibration unit 22C, and a module frame 23C. According to the above second preferred embodiment of the present invention, the active vibration unit 21C is embodied as a main vibration speaker.

The active vibration unit 21C can respond to audio signal input and vibrate to sound. The passive vibration unit 22C can respond to the vibration of the active vibration unit 21C and vibrate, so as to produce auxiliary sound effect, so as to enhance the bass sound effect of the loudspeaker module 20C.

Specifically speaking, referring to FIGS. 11 and 12, the passive vibration unit 22C comprises a vibration component 221C, a suspension edge 222C and a supporting frame 223C. The vibration component 221C is in the middle. The supporting frame 223C is mounted on the module frame 23C. The suspension edge 222C is extended between the vibration component 221C and the supporting frame 223C, so as to limit the vibration direction of the vibration component 221C. Specifically, the suspension edge 222C is utilized to limit the vibration component 221C to reciprocally move along a predetermined direction, so as to avoid the vibration component 221C from offsetting or shifting during the reciprocal motion.

More specifically speaking, the suspension edge 222C has an inner fringe 2221C and an outer fringe 2222C. The inner fringe 2221C of the suspension edge 222C is adapted to be integrally extended from an outer edge of the vibration component 221C or be attached to the outer edge of the vibration component 221C through glue or other adhesive. The outer fringe 2222C of the suspension edge 222C is adapted to be integrally extended from an inner edge of the supporting frame 223C or be attached to the inner edge of the supporting frame 223C through glue or other adhesive. As a result, the suspension edge 222C is extended between the vibration component 221C and the supporting frame 223C. It is worth mentioning that the suspension edge 222C may also extend to cover the outer surface(s) of the vibration component 221C.

The suspension edge 222C has an elastic ability. For instance, the suspension edge 222C can be made of elastic material, for example but not limited to, rubber materials and etc. Therefore, when the vibration component 221C responds to the vibration of the active vibration unit 21C and vibrates, if the vibration component 221C moves upward along the predetermined direction, the suspension edge 222C pulls the vibration component 221C downward along the predetermined direction, providing a tendency and shifting force to drive the vibration component 221C to displace and return back to its original condition, and correspondingly, if the vibration component 221C moves downward along the predetermined direction, the suspension edge 222C pulls the vibration component 221C upward along the predetermined direction, that also provides a tendency and shifting force to drive the vibration component 221C to displace and return back to its original condition.

Besides, when the vibration component 221C is vibrating upward or downward along the predetermined direction (up and down direction), the suspension edge 222C ensures the vibration component 221C only moving upward or downward along the predetermined direction, such that the suspension edge 222C does prevent the vibration component 221C from offsetting or displacement so as to can ensure the sound effect and quality of the loudspeaker module 20C.

It is worth mentioning that, even though the vibration components 221C of the passive vibration units 22C as illustrated in the FIGS. 11 and 12 are in a racetrack-like shape, according to the loudspeaker module 20C of other embodiments of the present invention, the shape of the vibration component 221C can also be embodied as other shapes, for example but not limited to, circular shape, oval shape, square shape, other polygonal shape, and etc.

Referring to FIGS. 11 and 12, the cross-sectional shape of the suspension edge 222C of the passive vibration unit 22C is in arch shape. That is, the suspension edge 222C has a convex side 2223C and a concave side 2224C. The convex side 2223C and the concave side 2224C of the suspension edge 222C are corresponding with each other. It is understandable that the convex side 2223C and the concave side 2224C of the suspension edge 222C are integrally formed at the time the suspension edge 222C was made.

Figure 13A:
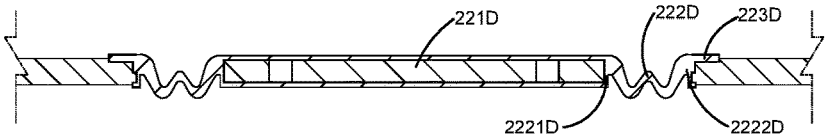
FIG. 13A is a sectional view of a passive vibration unit of the omnidirectional loudspeaker box according to a first alternative mode of the above second preferred embodiment of the present invention.

It is worth mentioning that, according to a first alternative mode of the loudspeaker module 20D as illustrated in FIG. 13A, a cross-sectional shape of the suspension edge 222D of a passive vibration unit 22D can also be made in W shape.

Figure 13B:
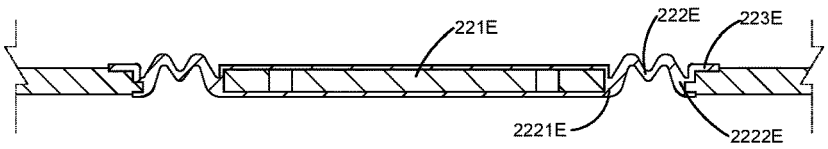
FIG. 13B is a sectional view of a passive vibration unit of the omnidirectional loudspeaker box according to a second alternative mode of the above second preferred embodiment of the present invention.

According to a second alternative mode of the loudspeaker module 20D as illustrated in FIG. 13B, a cross-sectional shape of the suspension edge 222E of a passive vibration unit 22E can also be made in M shape.

Figure 13C:
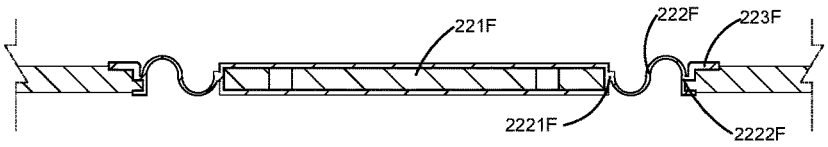
FIG. 13C is a sectional view of a passive vibration unit of the omnidirectional loudspeaker box according to a third alternative mode of the above second preferred embodiment of the present invention.

According to a third alternative mode of the loudspeaker module 20D as illustrated in FIG. 13C, a cross-sectional shape of the suspension edge 222F of a passive vibration unit 22F can also be made in S shape.

Figure 13D:
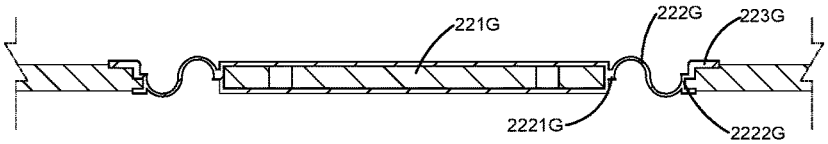
FIG. 13D is a sectional view of a passive vibration unit of the omnidirectional loudspeaker box according to a fourth alternative mode of the above second preferred embodiment of the present invention.

According to a fourth alternative mode of the loudspeaker module 20D as illustrated in FIG. 13D, a cross-sectional shape of the suspension edge 222G of a passive vibration unit 22G can also be made in an inverted S shape.

Figure 13E:
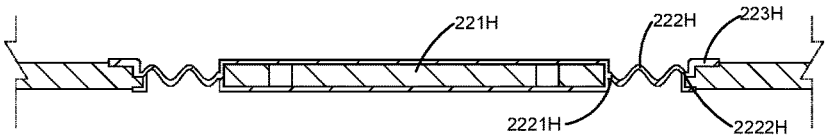
FIG. 13E is a sectional view of a passive vibration unit of the omnidirectional loudspeaker box according to a fifth alternative mode of the above second preferred embodiment of the present invention.

According to a fifth alternative mode of the loudspeaker module 20D as illustrated in FIG. 13E, a cross-sectional shape of the suspension edge 222H of a passive vibration unit 22H can also be made in a wavy shape.

Figure 13F:
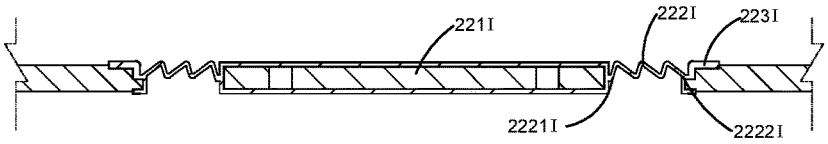
FIG. 13F is a sectional view of a passive vibration unit of the omnidirectional loudspeaker box according to a sixth alternative mode of the above second preferred embodiment of the present invention.

According to a sixth alternative mode of the loudspeaker module 20D as illustrated in FIG. 13F, a cross-sectional shape of the suspension edge 222I of a passive vibration unit 22I can also be made in a zigzag shape. Nevertheless, person skilled in the art should be able to understand that, for the loudspeaker module 20D of other embodiments, the cross sectional shapes of the suspension edge may also include V-shape, inverted V-shape, U-shape, inverted U-shape, and etc.

Figure 14:
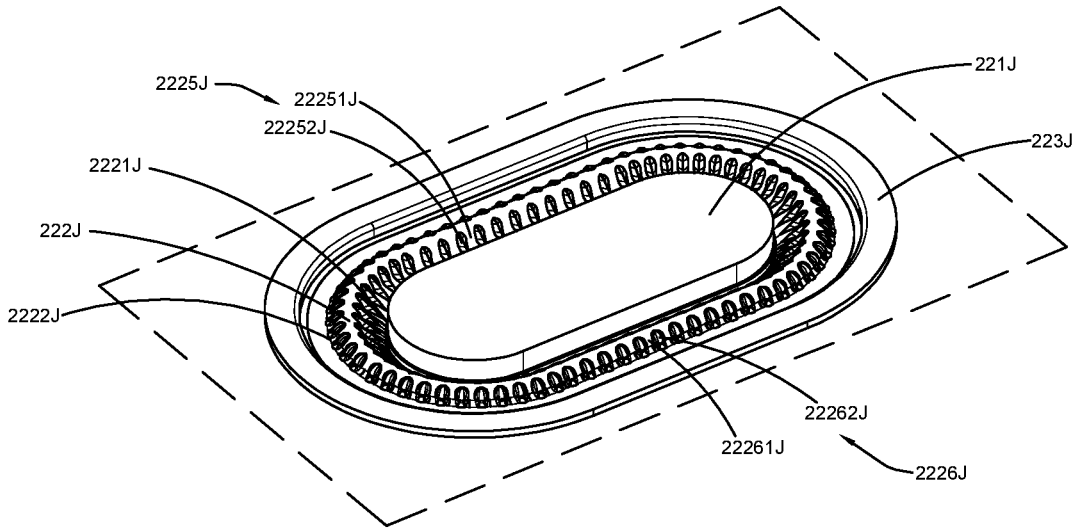
FIG. 14 is a perspective view of a passive vibration unit of the omnidirectional loudspeaker box according to a seventh alternative mode of the above second preferred embodiment of the present invention.
Figure 15:
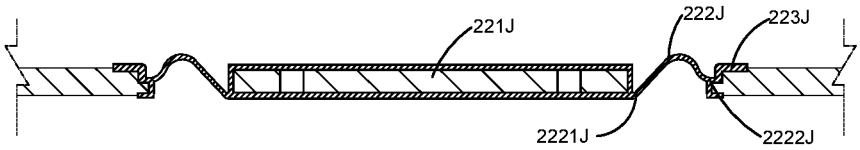
FIG. 15 is a sectional view of the passive vibration unit of the omnidirectional loudspeaker box according to a seventh alternative mode of the above second preferred embodiment of the present invention.

The loudspeaker module 20D according to a seventh alternative mode is illustrated in FIGS. 14 and 15, wherein a suspension edge 222J further comprises an inner suspension edge portion 2225J and an outer suspension edge portion 2226J. The inner suspension edge portion 2225J and the outer suspension edge portion 2226J of the suspension edge 222J are integrally formed, while the cross-sectional shape of the suspension edge 222J is able to be made in an arch shaped or other shape. The free fringe of the inner suspension edge portion 2225J of the suspension edge 222J forms the inner fringe 2221J of the suspension edge 222J.

The free fringe of the outer suspension edge portion 2226J of the suspension edge 222J forms the outer fringe 2222J of the suspension edge 222J.

The inner suspension edge portion 2225J of the suspension edge 222J comprises an inner suspension edge body 22251J and a plurality of inner elastic ribs 22252J. The inner elastic ribs 22252J are spacedly and annularly provided on the inner suspension edge body 22251J. Alternatively, the inner elastic ribs 22252J can be spacedly, annularly and integrally arranged on the inner suspension edge body 22251J. In addition, the inner elastic ribs 22252J protrude from the surface of the inner suspension edge body 22251J, such that the inner elastic ribs 22252J respectively form first protruding bodies 222521J on a side of the inner suspension edge portion 2225J and form first grooves 222622J on the other side of the inner suspension edge portion 2225J. In other words, each of the inner elastic ribs 22252J protrudes from the plane surface of the inner suspension edge body 22251J at the side of the inner suspension edge portion 2225J and indents from the plane surface of the inner suspension edge body 22251J at the other side of the inner suspension edge portion 2225J.

It is worth mentioning that each of the inner elastic ribs 22252J may also downwardly protrudes from the plane surface of the inner suspension edge body 22251J at the inner suspension edge body 22251J, so as to form the first protruding body 222521J on the lower side of the inner suspension edge portion 2225J and form the first groove 222622J on the upper side of the inner suspension edge portion 2225J, alternatively.

Preferably, two adjacent inner elastic ribs 22252J are spacedly arranged with each other and a plurality of the inner elastic ribs 22252J are radially and evenly arranged around the vibration component 221J, so as to limit the vibration direction of the vibration component in the predetermined direction. Correspondingly, the outer suspension edge portion 2226J of the suspension edge 222J comprises an outer suspension edge body 22261J and a plurality of outer elastic ribs 22262J. The outer elastic ribs 22262J are spacedly and annularly provided on the outer suspension edge body 22261J. Alternatively, the outer elastic ribs 22262J can be spacedly, annularly and integrally arranged on the outer suspension edge body 22261J. The outer elastic ribs 22262J protrude from the surface of the outer suspension edge body 22261J, such that the outer elastic ribs 22262J form second protruding bodies 222621J on a side of the outer suspension edge portion 2226J respectively and form second grooves 222622J on the other side of the outer suspension edge portion 2226J respectively. In other words, each of the outer elastic ribs 22262J protrudes from the plane surface of the outer suspension edge body 22261J at the side of the outer suspension edge portion 2226J and indents from the plane surface of the outer suspension edge body 22261J at the other side of the outer suspension edge portion 2226J.

It is worth mentioning that each of the outer elastic ribs 22262J may also downwardly protrudes from the plane surface of the outer suspension edge body 22261J at the outer suspension edge body 22261J, so as to form the second protruding body 222621J on the lower side of the outer suspension edge portion 2226J and form the second groove 222622J on the upper side of the outer suspension edge portion 2226J.

Preferably, two adjacent outer elastic ribs 22262J are spacedly arranged with each other and a plurality of the outer elastic ribs 22262J are radially and evenly arranged around the vibration component 221J, so as to limit the vibration direction of the vibration component in the predetermined direction.

It is worth mentioning that the inner elastic ribs 22252J and the outer elastic ribs 22262J can be arranged in a corresponding one-to-one manner. In other words, the inner elastic ribs 22252J of the inner suspension edge portion 2225J of the suspension edge 222J and the outer elastic ribs 22262J of the outer suspension edge portion 2226J are arranged and matched respectively and correspondingly with each other in an one-to-one manner. Such that, the suspension edge 222J can comprise many sets of elastic ribs, wherein each set of the elastic ribs respectively comprises one inner elastic rib 22252J of the inner suspension edge portion 2225J and one outer elastic rib 22262J of the outer suspension edge portion 2226J. The elastic ribs are alternately and spacedly arranged along the annular direction. It is understandable that the arrangement and geometry of the elastic ribs match the shape of the suspension edge 222J. For instance, when the suspension edge 222J is in approximately annular shape, the elastic ribs are arranged along the radial direction.

Figure 16:
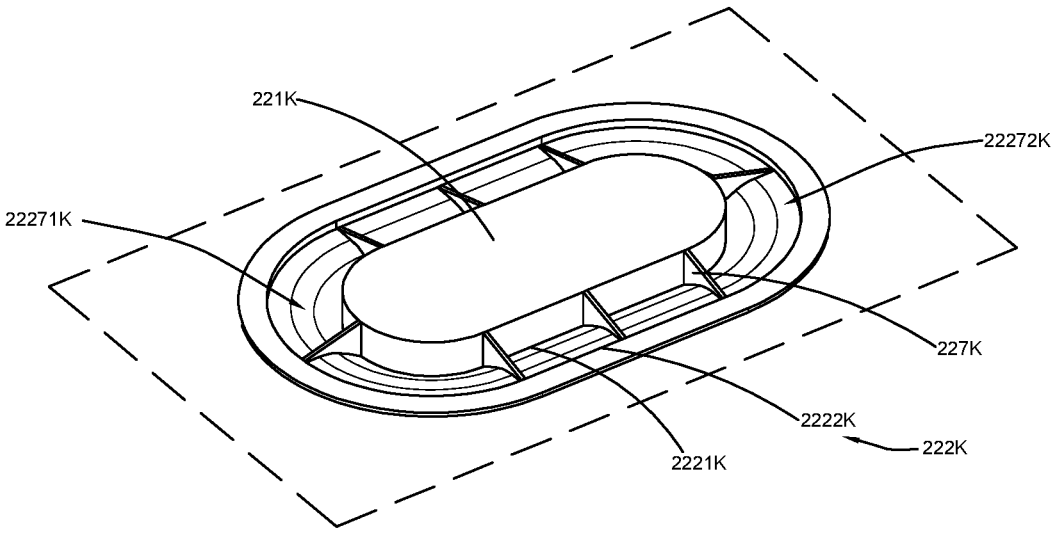
FIG. 16 is a perspective view of a passive vibration unit of the omnidirectional loudspeaker box according to an eighth alternative mode of the above second preferred embodiment of the present invention.
Figure 17:
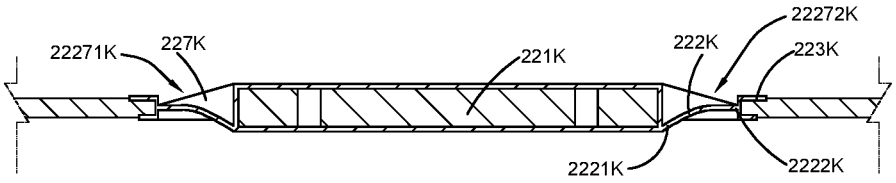
FIG. 17 is a sectional view of the passive vibration unit of the omnidirectional loudspeaker box according to an eighth alternative mode of the above second preferred embodiment of the present invention.

FIGS. 16 and 17 illustrate the loudspeaker module 20D according to an eighth alternative mode, wherein the suspension edge 222K has a plurality of spacing and enforcing ribs 2227K arranged on the surface thereof. Each of the spacing and enforcing ribs 2227K integrally extends between the vibration component 221K and the supporting frame 223K, so as to form an up-and-down structure between the vibration component 221K and the supporting frame 223K.

The spacing and enforcing ribs 2227K of the suspension edge 222K are for reinforcing a limiting function of the suspension edge 222K, so as to prevent the vibration component 221K from deviating from the predetermined direction when vibrating. Specifically speaking, when the vibration component 221K vibrating along the predetermined direction is going to deviate from the predetermined direction and be offsetting and displacing, the corresponding spacing and enforcing ribs 2227K would provide an opposite pulling force that counter-balances the offset force of the vibration component 221K.

It is worth mentioning that the spacing and enforcing rib 2227K are able to be extended along a perpendicular direction to an outer peripheral surface of the corresponding vibration component 221K and an inner peripheral surface of the corresponding supporting frame 223K, as illustrated in FIG. 16. According to other embodiment, the spacing and enforcing ribs 2227K may also be extended obliquely or along the radial direction of the vibration component 221K. Such arrangements of the spacing and enforcing ribs 2227K may provide corresponding pulling forces along these directions, so as to prevent the vibration component 221K from offsetting to and displacing from these directions.

It is also worth mentioning that the spacing and enforcing ribs 2227K can be evenly arranged around the vibration component 221K and symmetrically arranged to regard the vibration component 221K as the center. According to the embodiment as illustrated in FIG. 16, the spacing and enforcing rib 2227K comprises a left spacing and enforcing rib 22271K and a right spacing and enforcing rib 22272K. When the vibration component 221K reciprocally vibrates along the predetermined direction (up and down direction), if the vibration component 221K is offsetting or shifting to the left, a pulling force in the opposite direction will be applied through the right spacing and enforcing ribs 22272K, such that the right offset or shift of the vibration component 221K can be prevented. On the contrary, if the vibration component 221K is offsetting or shifting to the right, a pulling force in the opposite direction will be applied through the left spacing and enforcing ribs 22271K, such that the left offset or shift of the vibration component 221K can be prevented. Accordingly, the suspension edge 222K can effectively restrict and limited the vibration direction of the vibration component 221K along the predetermined directions.

According to a ninth alternative mode of the loudspeaker module 20D as illustrated in FIGS. 18-21, the suspension edge 222L is in wavy shape and comprises a plurality of wavy spacing segments 2228L continuously arranged along the circumference direction, such that the wavy spacing segments 2228L connect with each other to form a wavy structure around the vibration component 221L.

The wavy spacing segments 2228L of the suspension edge 222L are adapted for limiting function to prevent the vibration component 221L from offsetting or deviating when it is vibrating along the predetermined direction. Specifically speaking, when the vibration component 221L is going to deviate from the predetermined direction and offset or shift toward another direction, one or more the corresponding wavy spacing segments 2228L will provide an opposite pulling force to counter-balance and cancel out the offset force of the vibration component 221L. It is worth mentioning that the wavy spacing segments 2228L can be evenly arranged around the vibration component 221L and symmetrically arranged to regard the vibration component 221L as the center.

Figure 18:
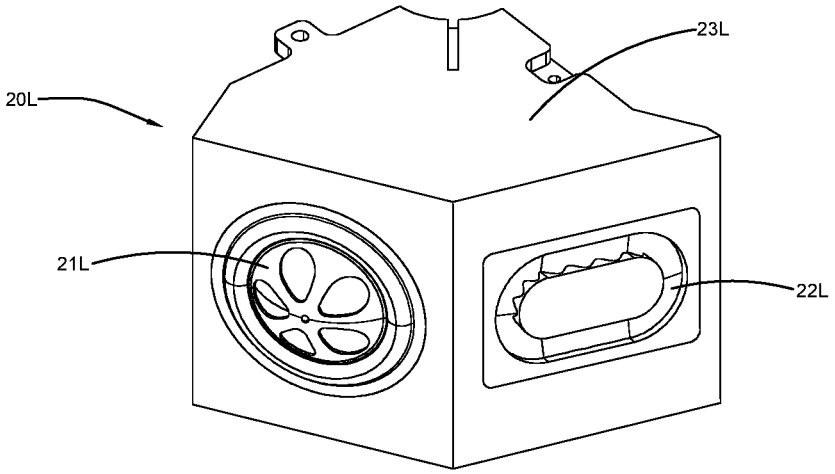
FIG. 18 is a perspective view illustrating an application of a passive vibration unit of the omnidirectional loudspeaker box according to a ninth alternative mode of the above second preferred embodiment of the present invention.
Figure 19:
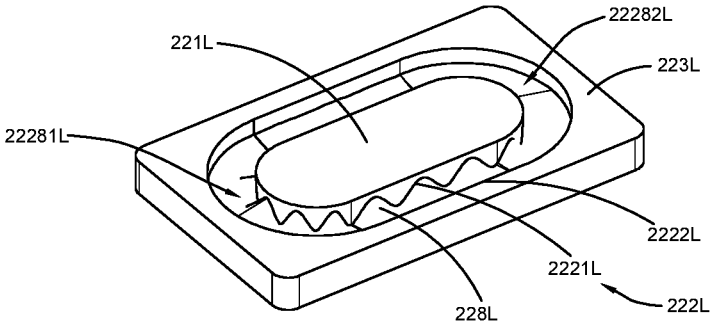
FIG. 19 is a perspective view of the passive vibration unit of the omnidirectional loudspeaker box according to the above ninth alternative mode of the above second preferred embodiment of the present invention.
Figure 20:
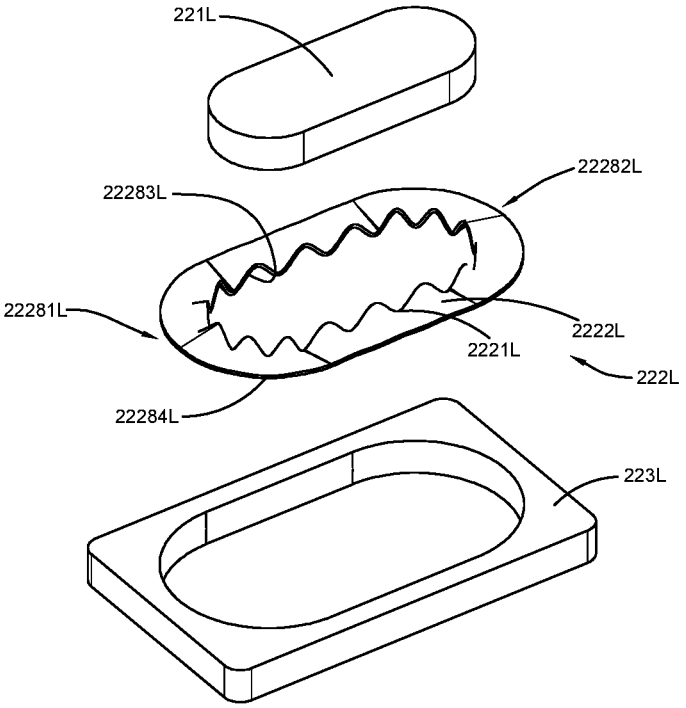
FIG. 20 is an exploded view of the passive vibration unit of the omnidirectional loudspeaker box according to the above ninth alternative mode of the above second preferred embodiment of the present invention.
Figure 21:
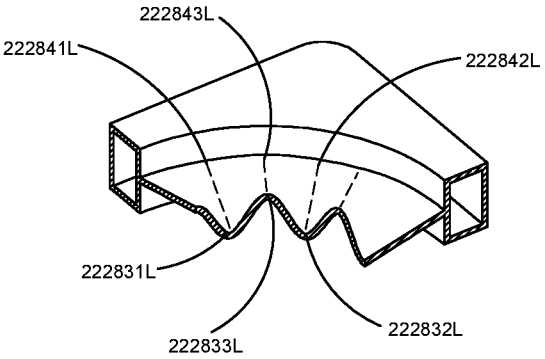
FIG. 21 is a partial sectional view of the passive vibration unit of the omnidirectional loudspeaker box according to the above ninth alternative mode of the above second preferred embodiment of the present invention.

Referring to FIG. 18, the wavy spacing segments 2228L of the suspension edge 222L comprises a left wavy spacing segment 22281L and a right wavy spacing segment 22282L. When the passive vibration component 22L responds to the vibration of the active vibration unit 21 to be driven to vibrate, the vibration component 221L moves reciprocally along the predetermined direction (e.g. the up and down direction). If the vibration component 221L is going to be offsetting or shifting to the left, an opposite pulling force is applied through the right wavy spacing segment 22282L to counter-balance and cancel out the offsetting or shifting of the vibration component 221L, such that the left offsetting or shifting of the vibration component 221L can be prevent. On the contrary, if the vibration component 221L is going to be offsetting or shifting to the right, an opposite pulling force is applied through the left wavy spacing segments 22281L to counter-balance and cancel out the offsetting or shifting, such that the left offsetting or shifting of the vibration component 221L can be prevented. Accordingly, the suspension edge 222L can effectively restrict to the limited direction of the vibration component 221L along the predetermined direction.

Besides, each of the wavy spacing segments 2228L of the suspension edge 222L comprises a vibration component coupling end 22283L and a supporting frame coupling end 22284L. The cross-sectional shape of the vibration component coupling end 22283L along the circumference direction can be in arch shape. In addition, the vibration component coupling end 22283L is connected with the outer edge of the vibration component 221L, wherein the supporting frame coupling end 22284L is utilized for connecting with the supporting frame 223L.

Further, the vibration component coupling end 22283L has two lower junctions 222831L and 222832L and an upper junction 222833L, wherein the connecting lines among the two lower junctions 222831L and 222832L and the upper junction 222833L can be in a triangular shape. Then, there are three junctions 222841L, 222842L, and 222843L provided through extending the two lower junctions 222831L and 222832L and the upper junction 222833L toward the fringe of the supporting frame 223L. These three junctions 222841L, 222842L, and 222843L are all formed on the supporting frame coupling end 22284L. Besides, the connecting lines among these three junctions 222841L, 222842L, and 222843L are in a curvy manner. In other words, according to this embodiment, the wavy spacing segment 2228L has an inner periphery and an outer periphery. The inner periphery connected with the outer edge of the vibration component 221L presents a wavy or arch shape. The outer periphery connected with the fringe of the supporting frame 223L presents a curvy shape and is on the same plane to the central axis that is perpendicular to the vibration component 221L.

Figure 22:
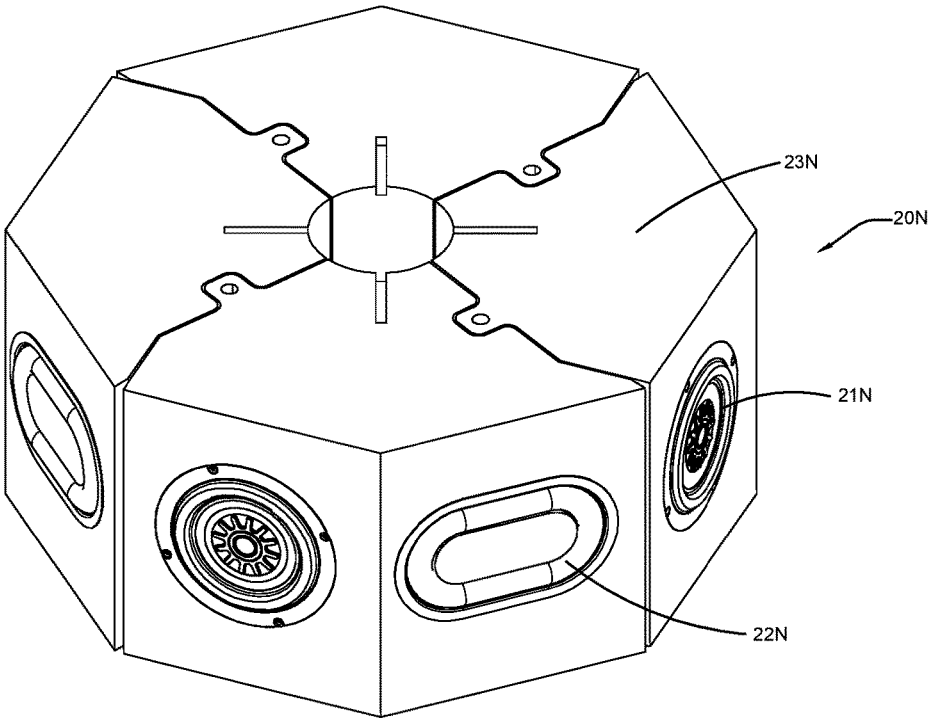
FIG. 22 is a perspective view of an omnidirectional loudspeaker box according to a third preferred embodiment of the present invention.
Figure 23:
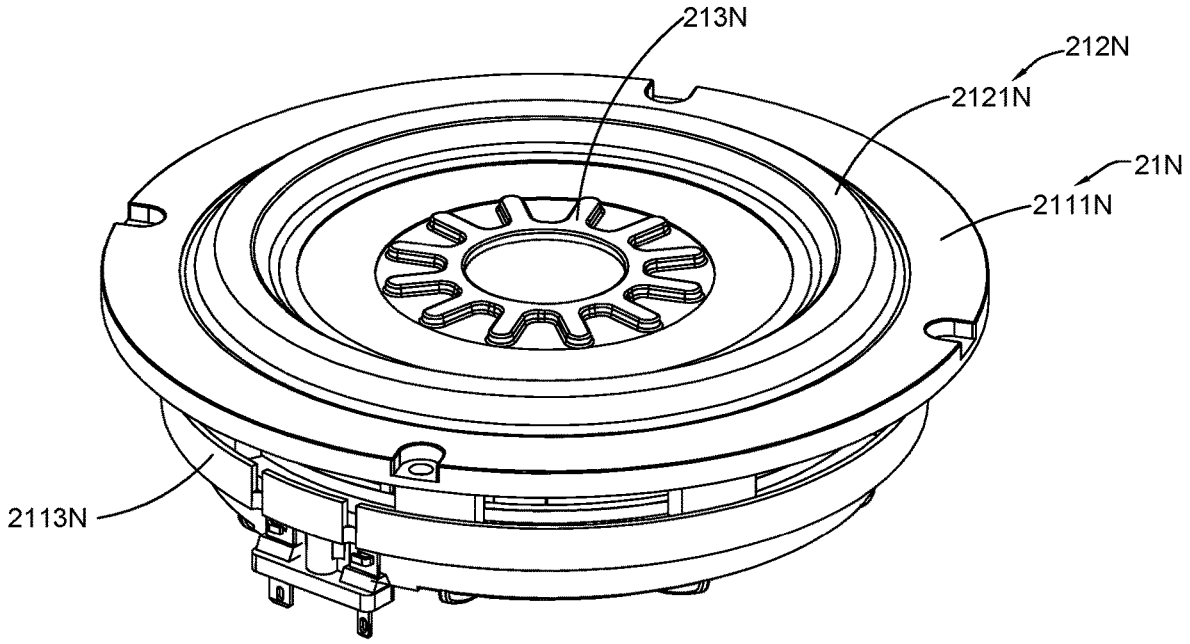
FIG. 23 is a perspective view of a loudspeaker module of the omnidirectional loudspeaker box according to the above third preferred embodiment of the present invention.
Figure 24:
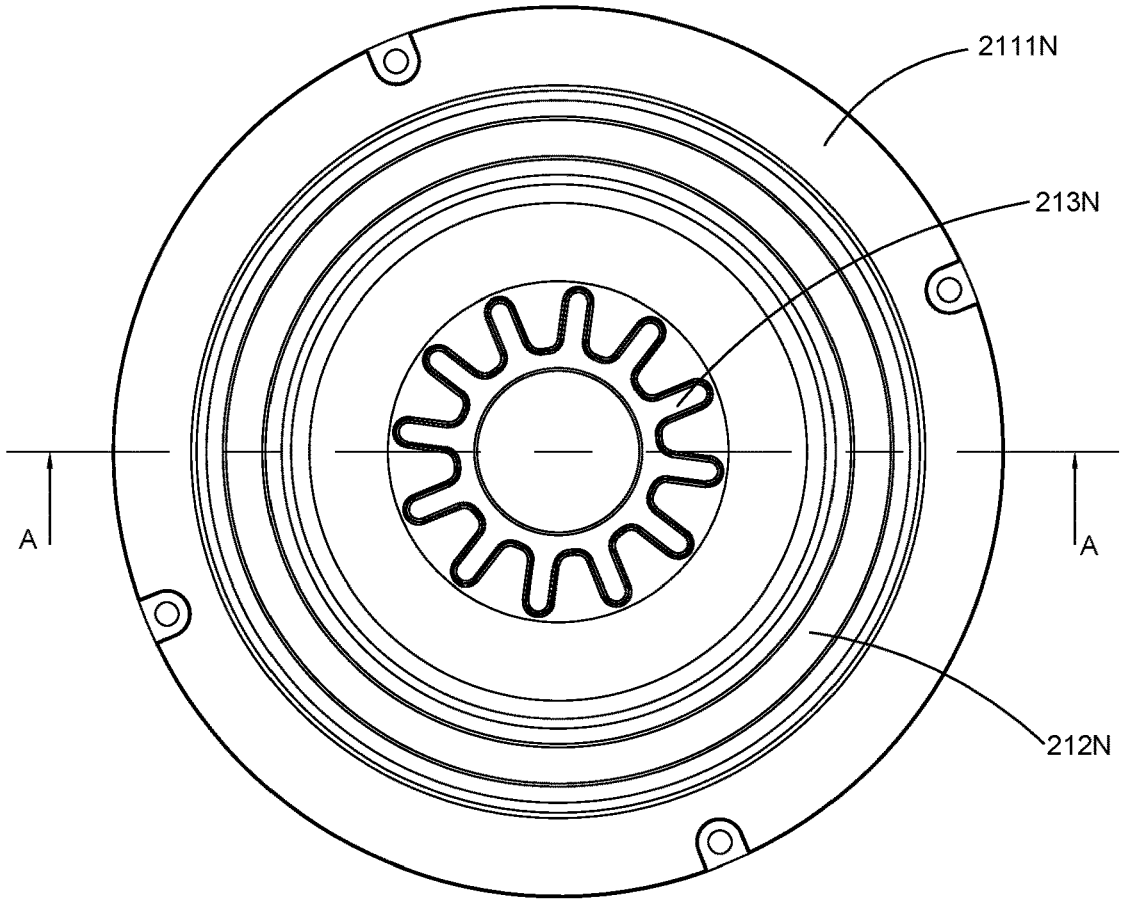
FIG. 24 is a top view of the loudspeaker module according to the above third preferred embodiment of the present invention.
Figure 25:
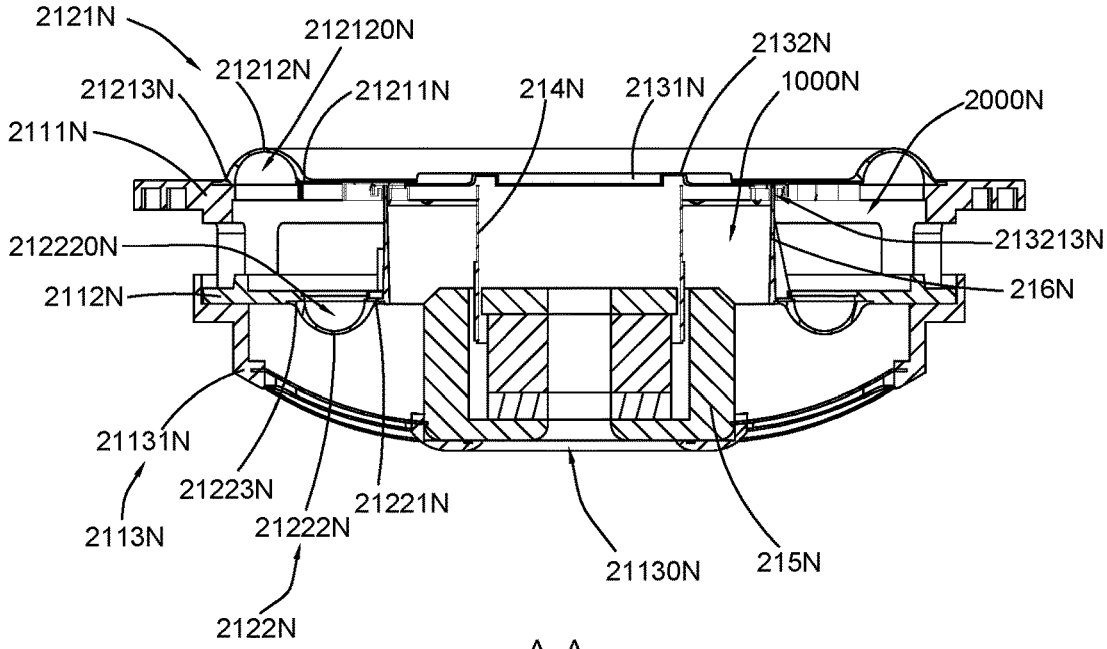
FIG. 25 is a sectional view of the loudspeaker module according to the above third preferred embodiment of the present invention.

An omnidirectional loudspeaker box according to a third preferred embodiment of the present invention is illustrated in FIG. 22, which comprises a plurality of loudspeaker modules 20N uniformly disposed in an annular configuration. According to the above third preferred embodiment of the present invention, each of the loudspeaker modules 20N comprises an active vibration unit 21N, at least a passive vibration unit 22N and a module frame 23N.

Referring to FIGS. 23-31, a dual-suspension edge unit 212N and the active vibration unit 21N assembled with the dual-suspension edge unit 212N according to the above third preferred embodiment of the present invention are illustrated, wherein the active vibration unit 21N comprises a frame assembly 211N, a dual-suspension edge unit 212N, a connector 216N, a vibration unit 213N, a voice coil 214N, and a magnetic coil unit 215N. Person skilled in the art should be able to understand that the dual-suspension edge unit 212N of the present invention may also be utilized in many other sound devices, including the active vibration unit 21N and etc.

According to the above third preferred embodiment of the present invention, the frame assembly 211N, the dual-suspension edge unit 212N, the connector 216N, the vibration unit 213N, the voice coil 214N, and the magnetic coil unit 215N define and form a vibration chamber 1000N and a supporting chamber 2000N of the active vibration unit 21N of the present invention. In other words, the dual-suspension edge unit 212N and the connector 216N divide a supporting frame chamber 3000N formed and defined by the frame assembly 211N into the vibration chamber 1000N and the supporting chamber 2000N which are arranged in an overlapped manner, so as to change the two longitudinally aligned and arranged chambers of the conventional art into two laterally aligned and arranged overlapping chambers, such that the overall dimension of the active vibration unit 21N can thus be reduced. Specific formation of the supporting chamber 2000N and the vibration chamber 1000N of the active vibration unit 21N will be disclosed in detail in the following.

The frame assembly 211N supports the dual-suspension edge unit 212N. The dual-suspension edge unit 212N is attached on the vibration unit 213N. The vibration unit 213N is connected with the voice coil 214N. The voice coil 214N is connected with the magnetic coil unit 215N. The magnetic coil unit 215N and the voice coil 214N magnetically induce with each other, so as to drive the vibration unit 213N to vibrate and reproduce the sound. In other words, appreciated to electromagnetic induction, in response to the audio signal input, the voice coil 214N moves reciprocally to drive the vibration unit 213N to vibrate. In order to provide a better sound quality, the vibration unit 213N is driven by the voice coil 214N and the vibration of the vibration unit 213N also drives the dual-suspension edge unit 212N to act. Besides, the dual-suspension edge unit 212N also serves as a brake to restrict the movement of the vibration unit 213N in a certain extent, such that the vibration unit 213N can only reciprocally move in a direction with an even and uniform amplitude. For example, when the vibration unit 213N is placed horizontally, the vibration unit 213N can only reciprocally move in a vertical (up-and-down) direction, while the upward displacement of the vibration unit 213N is the same as the downward displacement of the vibration unit 213N.

In particular, the dual-suspension edge unit 212N further comprises a passive suspension edge 2121N and a brake suspension edge 2122N. The vibration unit 213N further comprises a first vibration component 2131N and a second vibration component 2132N. The frame assembly 211N further comprises a first support frame 2111N, a second support frame 2112N and a third supporting frame 2113N.

Referring to FIGS. 25, 28A, 28B, and 31, the third supporting frame 2113N is adapted for mounting the magnetic coil unit 215N and other components. The third supporting frame 2113N comprises a third supporting frame body 21131N and a magnetic coil mounting hole 21130N. The magnetic coil mounting hole 21130N is arranged and provided at the center of the bottom of the third supporting frame body 21131N for mounting the magnetic coil unit 215N. The active vibration unit 21N also comprises an electrical connector 2171N and an electrical terminal 2172N. According to the above third preferred embodiment of the present invention, the electrical terminal 2172N is arranged on the outside of the supporting frame body 21131N. The electrical connector 2171N also comprises an electrical connector body 21711N and has a central hole 21710N provided therein. The electrical connector body 21711N of the electrical connector 2171N is arranged on the bottom of the supporting frame body 21131N, while the central hole 21710N of the electrical connector 2171N is arranged corresponding to the magnetic coil mounting hole 21130N of the third supporting frame 2113N. The magnetic coil unit 215N further comprises a magnetic coil body 2151N, a first pole piece 2152N, and a second pole piece 2153N. The first pole piece 2152N and the second pole piece 2153N are electrically connected. The magnetic coil body 2151N also forms and defines a magnetic coil chamber 2154N of the magnetic coil unit 215N. The voice coil 214N is at least partially sleeved in the magnetic coil chamber 2154N of the magnetic coil unit 215N. Accordingly, when the magnetic coil unit 215N is arranged on the bottom of the third supporting frame 2113N, which means when the magnetic coil body 2151N of the magnetic coil unit 215N is arranged at the magnetic coil mounting hole 21130N, the electrical connector 2171N and the electrical terminal 2172N are electrically connected. Therefore, when the electrical terminal 2172N is powered on, the electric current will electrify the first pole piece 2152N and the second pole piece 2153N through the electrical connector 2171N, such that the voice coil 214N, due to the electromagnetic induction between the voice coil 214N and the magnetic coil unit 215N, can respond to audio signal input and conduct reciprocal motion.

Further, the third supporting frame body 21131N comprises a third supporting frame mounting platform 211311N arranged on the top thereof. The second support frame 2112N is arranged on the top of the third supporting frame body 21131N, which is to be arranged on the third supporting frame mounting platform 211311N, such that the third supporting frame 2113N can be connected with and support the second support frame 2112N. In other words, the fringe of the bottom of the second support frame 2112N is attached on the fringe of the top of the third supporting frame 2113N, so as to be supported by the third supporting frame 2113N.

Further, the second support frame 2112N is connected with the brake suspension edge 2122N, which means that the second support frame 2112N can stably support the brake suspension edge 2122N. More specifically, the second support frame 2112N comprises a second support frame body 21121N and a second support frame hole 21120N. The second support frame hole 21120N is arranged and provided at the center of the second support frame body 21121N. According to the above third preferred embodiment of the present invention, the voice coil 214N and part of the magnetic coil unit 215N pass through the second support frame hole 21120N. The second support frame 21121N further comprises a second support frame inner frame portion 211211N, a second support frame edge portion 211212N, and a second support frame outer frame portion 211213N. The second support frame edge portion 211212N is extended upward and outward from the second support frame inner frame portion 211211N and the second support frame outer frame portion 211213N. The second support frame outer frame portion 211213N is arranged on the third supporting frame mounting platform 211311N of the third supporting frame body 21131N, such that the third supporting frame 2113N can be connected with and support the second support frame 2112N. The brake suspension edge 2122N is connected with the second support frame inner frame portion 211211N of the second support frame body 21121N, such that the second support frame 2112N can be connected with the brake suspension edge 2122N.

Further, the brake suspension edge 2122N also comprises a brake suspension edge inner periphery 21221N, a brake suspension edge body 21222N, and a brake suspension edge outer periphery 21223N. The braking suspension edge body 21222N is outward and protrudingly extended from the braking suspension edge inner periphery 21221N and the brake suspension edge outer periphery 21223N and encirclingly arranged to form a brake suspension edge hole 21220N of the brake suspension edge 2122N. The connector 216N passes through the brake suspension edge hole 21220N. In other words, when the active vibration unit 21N is placed horizontally as the illustrated in the drawings, the brake suspension edge inner periphery 21221N and the brake suspension edge outer periphery 21223N are on the same plane in the lateral section direction of the brake suspension edge 2122N, wherein the brake suspension edge body 21222N is integrally extended downwardly from the brake suspension edge inner periphery 21221N and the brake suspension edge outer periphery 21223N to form an arch structure with a certain curvature. The brake suspension edge outer periphery 21223N of the brake suspension edge 2122N is connected with the second support frame inner frame portion 211211N of the second support frame body 21121N, such that the brake suspension edge 2122N is connected with the second support frame 2112N.

Further, referring to FIGS. 28A-30, the connector 216N further comprises a connector body 2161N, a plurality of connector ribs 2162N, a connector extension 2163N, and a connector hole 2164N. The connector body 2161N is in annular shape and defines the connector hole 2164N therein. The voice coil 214N is accommodated in the connector hole 2164N. The connector extension 2163N is vertically extended outwardly from the bottom of the connector body 2161N and connected with the brake suspension edge inner periphery 21221N of the brake suspension edge 2122N, such that the connector 216N can be connected with the brake suspension edge 2122N. The two ends of each connector rib 2162N are respectively and perpendicularly extended outwardly from the outer side of the connector body 2161N and the connector extension connector extension 2163N, so as to enhance the stability of the connector 216N. In other words, the connector ribs 2162N are spacedly arranged, which may be evenly and uniformly arranged or not evenly and uniformly arranged. Each of the connector ribs 2162N can, according to this embodiment of the present invention, be embodied to be in right angled triangle-shape with one of the right angled edges being arranged on the connector extension 2163N and the other right angled edges being arranged on the outer side wall of the connector body 2161N. It is understandable that the above description of shape of the connector rib 2162N is only an example and there are other possible structures according to the inventive concept of the present invention, that the present invention shall not be limited in this manner. It is worth mentioning that, according to the above third preferred embodiment of the present invention, the connector body 2161N further comprises a plurality of arch inner grooves 21610N arranged on the top thereof. The arch inner grooves 21610N are spacedly arranged on the fringe of the top of the connector body 2161N.

Further, the first support frame 2111N comprises a first support frame body 21111N and has a first support frame hole 21110N arranged thereon. The first support frame body 21111N comprises an inner frame of first support frame 211111N and a first support frame 211112N. The inner frame portion of first support frame 211111N is formed through extending inwardly and downwardly from the first support frame 211112N in a concave manner. The passive suspension edge 2121N is connected with the outer frame portion 211112N of the first support frame 2111N.

Further, the passive suspension edge 2121N also comprises an inner periphery of passive suspension edge 21211N, a passive suspension edge body 21212N, and an outer periphery of passive suspension edge 21213N. The passive suspension edge body 21212N is protruded outwardly and protrudingly extended from the inner periphery of passive suspension edge 21211N and the outer periphery of passive suspension edge 21213N and encirclingly arranged to form a passive suspension edge 21210N of the passive suspension edge 2121N. In other words, when the active vibration unit 21N is placed horizontally as illustrated in the drawings, the inner periphery of passive suspension edge 21211N and the outer periphery of passive suspension edge 21213N are on the same plane in the lateral section direction of the passive suspension edge 2121N, wherein the passive suspension edge body 21212N is integrally extended upwardly from the inner periphery of passive suspension edge 21211N and the outer periphery of passive suspension edge 21213N to form an arch structure with a certain curvature. The outer periphery of passive suspension edge 21213N of the passive suspension edge 2121N is connected with the inner frame portion of first support frame 211111N of the first support frame body 21111N, such that the passive suspension edge 2121N is connected with the first support frame 2111N.

Further, the second vibration component 2132N of the vibration unit 213N comprises an annular second vibration body 21321N and has an annular opening 21320N. The annular opening 21320N is defined by the second vibration body 21321N. The first vibration component 2131N is connected with the second vibration component 2132N and the first vibration component 2131N closes the annular opening 21320N of the second vibration component 2132N. More specifically, the peripheral edge 213211N of the second vibration body 21321N is connected with the inner periphery of passive suspension edge 21211N of the passive suspension edge 2121N, such that the second vibration component 2132N can be connected with the passive suspension edge 2121N. The first vibration component 2131N is connected with the inner peripheral fringe 213212N of the second vibration component body 21321N, such that the first vibration component 2131N can be connected with the second vibration component 2132N and closes the annular opening 21320N of the second vibration component 2132N.

It is worth mentioning that the second vibration body 21321N of the second vibration component 2132N also has an annular connector spacing groove 213213N arranged on the bottom thereof. The fringe of the top of the connector body 2161N of the connector 216N is limited in the annular connector spacing groove 213213N, so as to enhance the stability of the connector 216N.

Further, the first vibration component 2131N also comprises a first vibration body 21311N and a reinforcing bar 21312N. The reinforcing bar 21312N is spacedly arranged on the first vibration body 21311N and made of rigid material, so as for reinforcing the strength of the first vibration body 21311N and prolong its service life.

It is worth mentioning that the first vibration body 21311N also has a limiting groove 213111N provided on the bottom thereof. The limiting groove 213111N is formed through protruding a middle portion of the first vibration body 21311N. The bottom of the limiting groove 213111N is arranged corresponding to the top fringe of the voice coil 214N. When the voice coil 214N responds to an audio signal input to be driven, the limiting groove 213111N provides the voice coil 214N an extended moving space.

It is worth mentioning that there is a plurality of circular holes 213112N formed in the peripheral fringe of the first vibration body 21311N. Correspondingly, the second vibration body 21321N has a plurality of compatible round grooves 213214N provided on the bottom thereof. The round grooves 213214N are spacedly arranged on the inner side of the annular connector spacing groove 213213N and compatibly corresponding to the circular holes 213112N respectively.

It is worth mentioning that the first support frame 2111N, the second support frame 2112N, and the third supporting frame 2113N can be assembled together through various manners, such as compatible screwing elements, heat-melting, ultrasonic welding, and etc. According to the above third preferred embodiment of the present invention, the first support frame body 21111N of the first support frame 2111N comprises a plurality of affixing teeth 211113N, spacedly arranged on the bottom of the first support frame inner frame portion 211111N. The second support frame body 21121N of the second support frame 2112N has a plurality of affixing grooves 211214N, spacedly arranged and distributed on the second support frame outer frame portion 211213N. The third supporting frame body 21131N and the third supporting frame 2113N has a plurality of affixing holes 211312N. The affixing teeth 211113N are respectively adapted for matchingly passing through the affixing grooves 211214N and the affixing holes 211312N respectively, such that the first support frame 2111N, the second support frame 2112N, and the third supporting frame 2113N can be assembled and connected together to form and define the supporting frame chamber 3000N. Certainly, according to other embodiments, because the affixing teeth 211113N, the affixing grooves 211214N, and the affixing holes 211312N are matched correspondingly to assemble and connect the first support frame 2111N, the second support frame 2112N, and the third supporting frame 2113N together, the affixing teeth 211113N may also be arranged on the second support frame 2112N or the third supporting frame 2113N, the affixing grooves 211214N may also be arranged on the first support frame 2111N or the third supporting frame 2113N, and the affixing holes 211312N may also be arranged on the first support frame 2111N or the second support frame 2112N. According to other embodiments, each of the first support frame 2111N, the second support frame 2112N, and the third supporting frame 2113N may have the affixing teeth 211113N, the affixing groove 211214N, and the affixing hole 211312N individually. Person skilled in the art should be able to understand that the above mentioned connection modes of the first support frame 2111N, the second support frame 2112N, and the third supporting frame 2113N are just examples, which shall not consider as limitation of the scope of the present invention.

Hence, according to this preferred embodiment of the present invention, the frame assembly 211N forms and defines the supporting frame chamber 3000N, and the voice coil 214N and the magnetic coil unit 215N are accommodated in the supporting frame chamber 3000N.

Further, according to the above third preferred embodiment of the present invention, the first vibration component 2131N of the vibration unit 213N is connected with the second vibration component 2132N. The peripheral edge of the second vibration component 2132N is connected with the inner fringe of the passive suspension edge 2121N. That is, the peripheral edge 213211N of the first vibration body 21321 of the second vibration component 2132N is connected with the passive suspension edge inner periphery 21211N of the passive suspension edge 2121N. Besides, the outer fringe of the passive suspension edge 2121N is connected with the inner frame portion of the first support frame 2111N. That is, the outer periphery of passive suspension edge 21213N of the passive suspension edge 2121N is connected with the inner frame portion of first support frame 211111N of the first support frame body 21111N. In addition, the outer frame portion of first support frame 2111N is connected with the second support frame 2112N. The inner frame portion of second support frame is connected with the outer fringe of the brake suspension edge 2122N. That is, the outer periphery of brake suspension edge 21223N of the brake suspension edge 2122N is connected with the inner frame portion of second support frame 211211N of the second support frame body 21121N. Also, the inner fringe of the brake suspension edge 2122N is connected with the connector 216N. That is, the connector extension 2163N of the connector 216N is connected with the inner periphery of brake suspension edge 21221N of the brake suspension edge 2122N. Further, the fringe of the top of the connector 216N is limited in the annular connector spacing groove 213213N of the second vibration component 2132N. Accordingly, the first support frame 2111N, the passive suspension edge 2121N, the vibration unit 213N, and the connector 216N define and form the supporting chamber 2000N therebetween.

Further, according to the above third preferred embodiment of the present invention, because the second support frame 2112N is arranged on the top of the third supporting frame body 21131N, which means to be arranged on the third supporting frame mounting platform 211311N, the third supporting frame 2113N is connected with and supports the second support frame 2112N. Then, the third supporting frame 2113N, the brake suspension edge 2133N, the connector 216N, and the second support frame 2112N define and form the vibration chamber 1000N, while the voice coil 214N and the magnetic coil unit 215N are accommodated in the vibration chamber 1000N.

Therefore, because of the arrangement of the parallel interlocking of the dual-suspension edge unit 212N and the connector 216N, the supporting frame chamber 3000N is divided into two laterally arranged overlapping supporting chamber 2000N and the vibration chamber 1000N, so as to guarantees the quality of the bass effect and reduces the overall thickness of the active vibration unit 21N.

Since the overall thickness of the active vibration unit 21N is reduced and the connector 216N and the dual-suspension edge unit 212N are provided, the bass effect of the active vibration unit 21N will be enhanced. When the active vibration unit 21N is powered on, due to electromagnetic induction, the voice coil 214N responds to audio signal input and is driven to axially move reciprocally. For example, when the active vibration unit 21N is placed vertically as illustrated in the drawings, the voice coil 214N can be driven to reciprocally move longitudinally. Because the upper part of the voice coil 214N is close to the vibration unit 213N, the vibration unit 213N can be driven by the reciprocal motion of the voice coil 214N to vibrate. Appreciated to the supports of the parallel interlocking of the dual-suspension edge unit 212N, the connector 216N, and the frame assembly 211N, the vibration unit 213N can move reciprocally in only one direction in an even and uniform amplitude. Thus, it can ensure the restoration of the sound effect, especially the bass effect.

Figure 26:
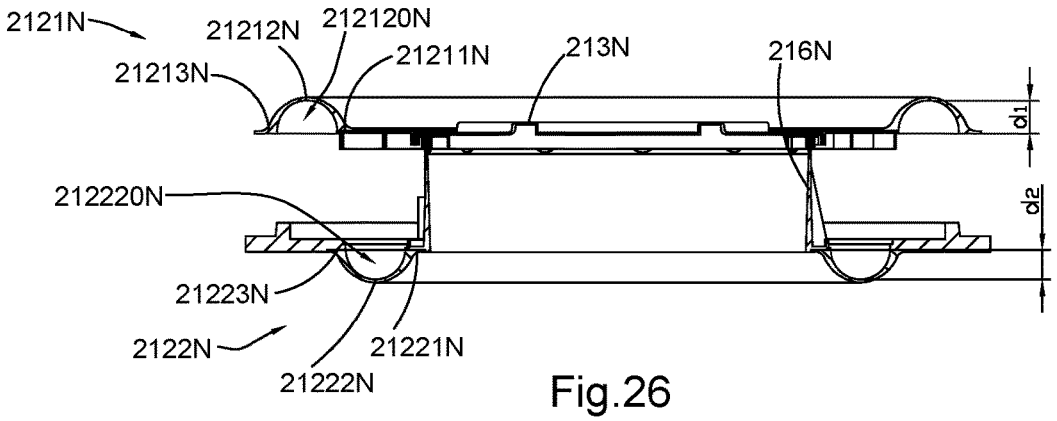
FIG. 26 is a sectional view illustrating a dual-suspension edge unit, an elastic-wave member, and a vibration unit of the loudspeaker module according to the above third preferred embodiment of the present invention.
Figure 27:
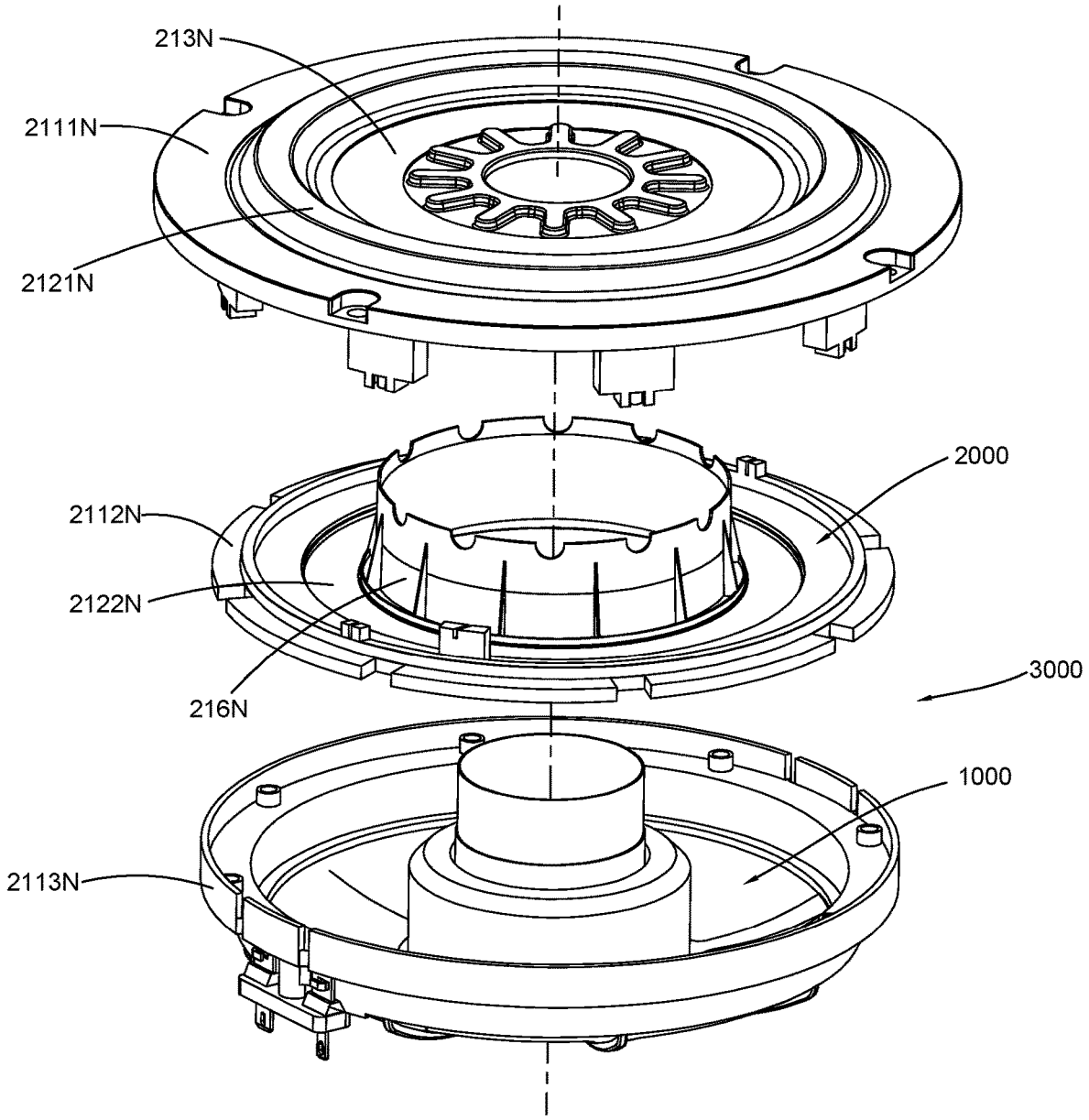
FIG. 27 is an exploded view of the loudspeaker module according to the above third preferred embodiment of the present invention.
Figure 28A:
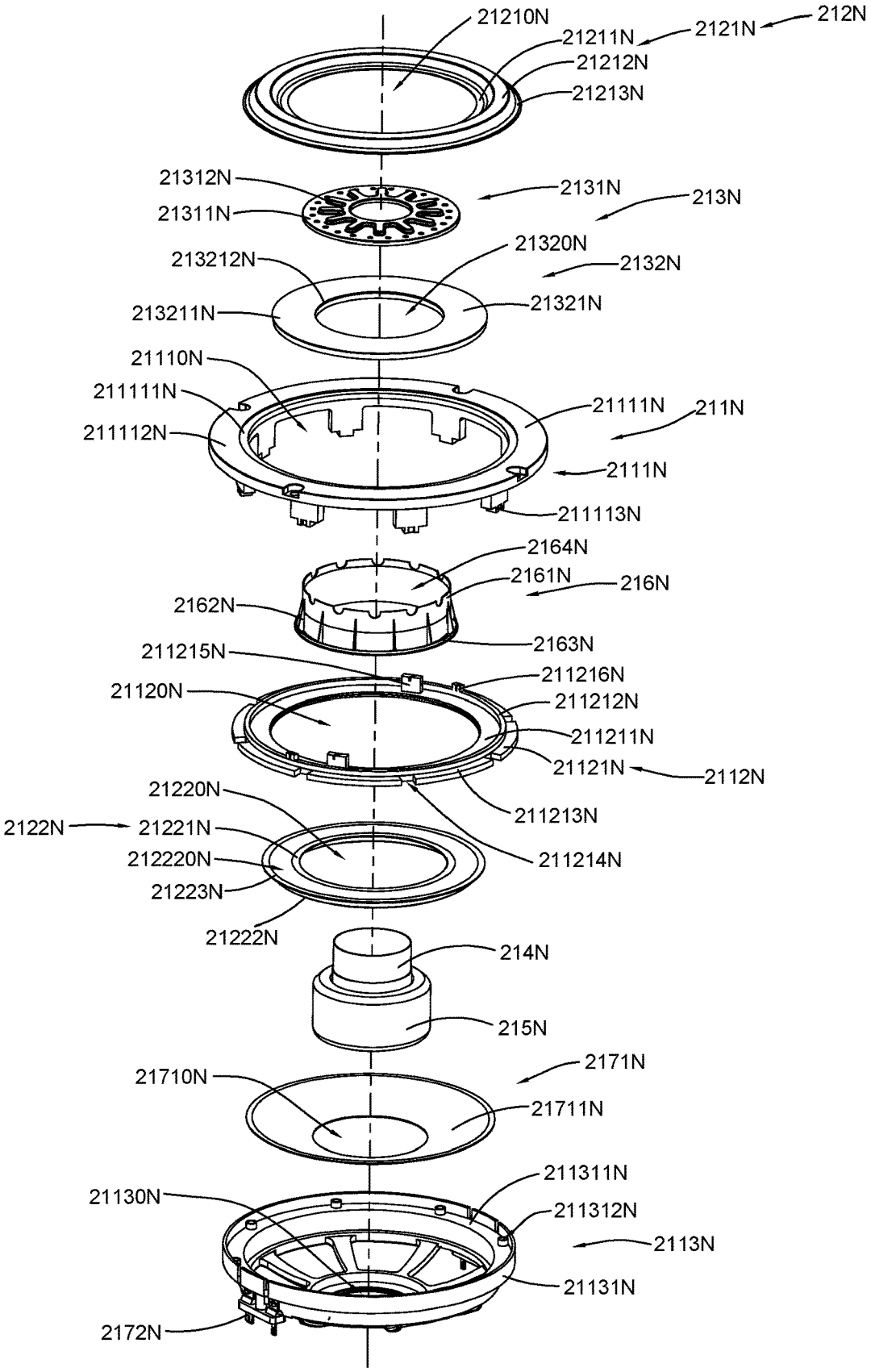
FIG. 28A is another exploded view of the loudspeaker module according to the above third preferred embodiment of the present invention.
Figure 28B:
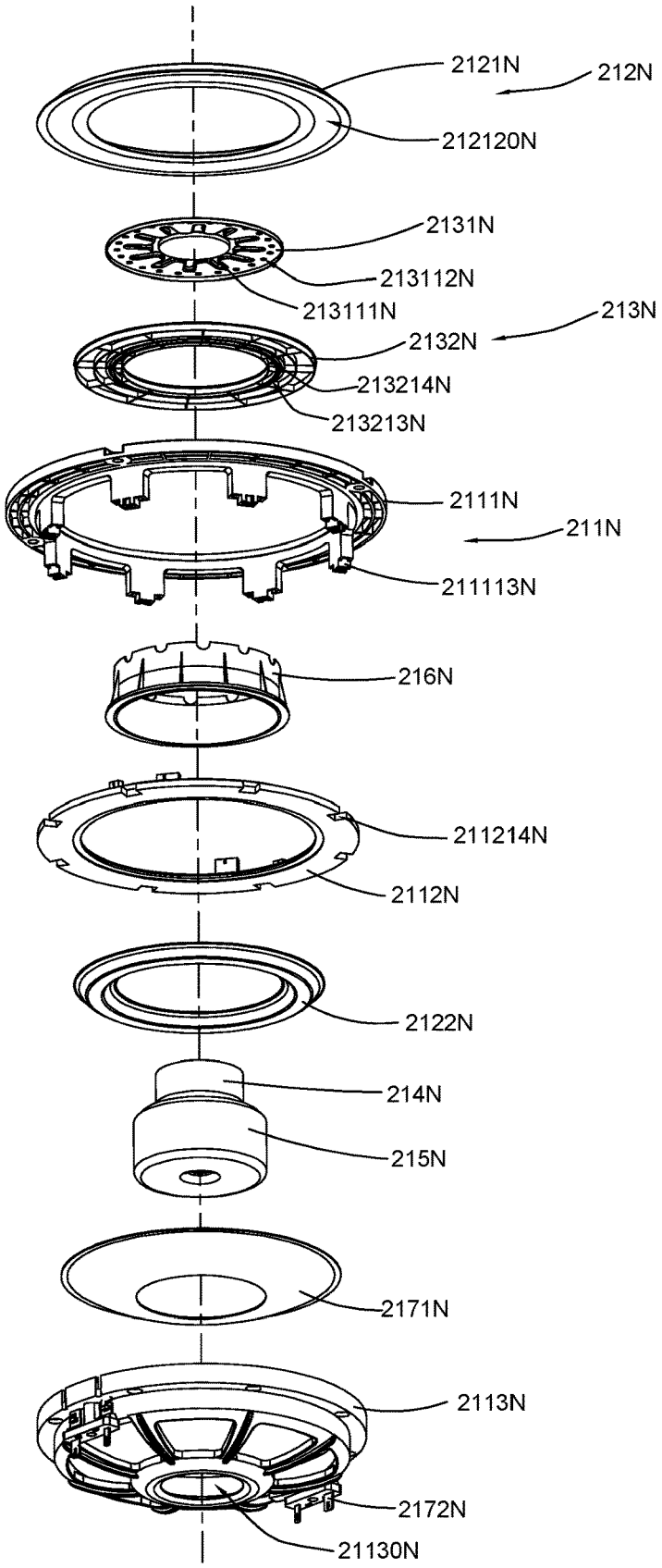
FIG. 28B is another exploded view of the loudspeaker module according to the above third preferred embodiment of the present invention.
Figure 29:
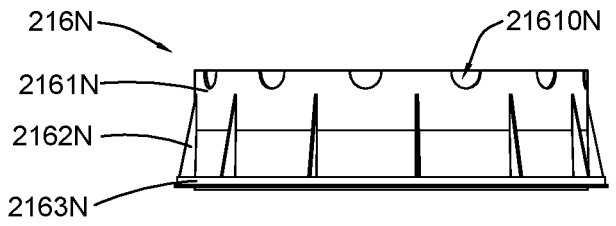
FIG. 29 is a perspective view of a folding elastic-wave member of the loudspeaker module according to the above third preferred embodiment of the present invention.
Figure 30:
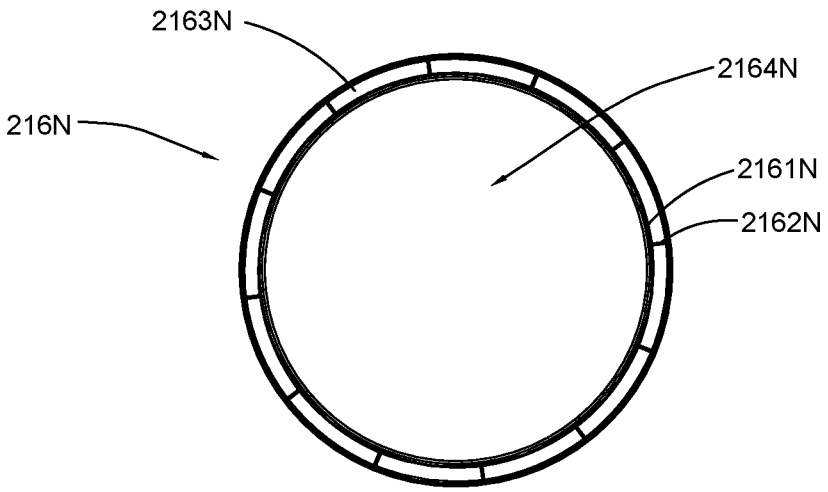
FIG. 30 is a top view of the folding elastic-wave member of the loudspeaker module according to the above third preferred embodiment of the present invention.
Figure 31:
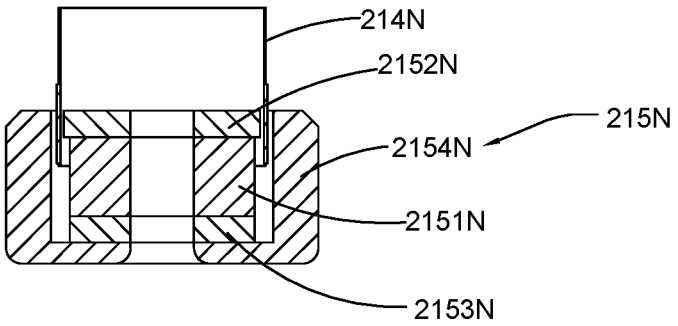
FIG. 31 is a sectional view of a voice coil and a magnetic coil unit of the loudspeaker module according to the above third preferred embodiment of the present invention.

It is worth mentioning that, as illustrated in FIG. 26, the passive suspension edge 2121N and the brake suspension edge 2122N of the dual-suspension edge unit 212N are arranged in a parallel interlocked manner. Especially, the passive suspension edge body 21212N has a passive arch annular chamber 212120N, while the brake suspension edge body 21222N has a brake arch annular chamber 212220N. The depth L1 of the passive arch annular chamber 212120N is numerically equal to the depth L2 of the brake arch annular chamber 212220N. However, in other words, according to the above third preferred embodiment of the present invention because the passive suspension edge 2121N has to agitate the air and therefore has a large diameter, the overall size of the brake suspension edge 2122N is relatively small comparing to the passive suspension edge 2121N. Nevertheless, the radian and the concave angle of the arch structure of the brake suspension edge 2122N and the arch structure of the passive suspension edge 2121N are numerically fixed. Of course, person skilled in the art should be able to understand that, as long as the widths of the openings of the annular chambers and the depths of the annular chambers formed by the arch structures of the passive suspension edge 2121N of the brake suspension edge 2122N are the same, the thicknesses of the brake suspension edge 2122N and the passive suspension edge 2121N may be different. The present invention shall not be limited in such aspect. The brake suspension edge 2122N can provide a braking function to the passive suspension edge 2121N.

It is worth mentioning that, as long as the depths of the protruding formed by the brake suspension edge 2122N and the passive suspension edge 2121N are numerically same, the shapes of the protruding formed by the brake suspension edge 2122N and the passive suspension edge 2121N may be unrestricted. Besides of the parallel interlocked arch structures as illustrated in the present embodiment, it may also have arch structures with same protruding direction or non-arch-protruding structure. For instance, according to other embodiments, the lateral section may be in the shape of bow, arch, triangle, quadrangle, polygon, semicircle, semi-oval, U-shape, V-shape, and etc.

It is worth mentioning that the dual-suspension edge unit 212N may not only prevent the vibration unit 213N from non-axial wobbling and offsetting, but also ensure that the vibration unit 213N is allowed to have amplitude that is large enough. Specifically, it ensures that the axial displacement of the vibration unit 213N is large enough, so as to guarantee that the stroke of the vibration unit 213N can reproduce the bass ideally.

It is worth mentioning that the dual-suspension edge unit 212N of the present invention is made of elastic material. It is worth mentioning that the cross-sectional shapes of the passive suspension edge 2121N and the brake suspension edge 2122N of the dual-suspension edge unit 212N are annular. In other words, the passive suspension edge body and the brake suspension edge body are both head and tail connected integrally to define and form an annular shape laterally. In other words, the passive suspension edge hole 21210N and the brake suspension edge hole 21220N are round holes. Person skilled in the art should be able to understand that the above description of the shapes is just examples rather than limitations to the present invention. According to other embodiments, the cross-sectional shapes of the passive suspension edge 2121N and the brake suspension edge 2122N of the dual-suspension edge unit 212N may also be selected from the group consisting of annular, triangular, quadrangular, polygonal, and other shapes.

It is worth mentioning that the omnidirectional loudspeaker box according to the present invention may also be utilized for the projector client. Specifically, it can be separately or jointly arranged with a projector.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An omnidirectional loudspeaker box, comprising a plurality of loudspeaker modules uniformly disposed in an annular configuration, wherein each of said loudspeaker modules comprises at least one active vibration unit and at least one passive vibration unit, which are uniformly disposed in an annular configuration, wherein said at least one active vibration unit is arranged to vibrate in responsive to an input of external signals that drives said at least one passive vibration unit to vibrate together, wherein said active vibration unit comprises:

at least a magnetic coil unit;

at least a voice coil, driven by said magnetic coil unit to reciprocally move;

at least a vibration unit, driven by said voice coil to reciprocally move;

at least a frame assembly;

at least a suspension edge, connected to said vibration unit and said frame assembly; and at least a folding elastic-wave member, connected with said suspension edge, said frame assembly and said vibration unit, wherein said folding elastic-wave member comprises a resilient circular periphery portion connected to said frame assembly and a tubular portion bendingly extended from said circular periphery portion, wherein said tubular portion comprises at least a tubular portion body and at least a tubular portion hole arranged thereon, wherein said tubular portion body is arranged in an annular manner so as to define said tubular portion hole therein, wherein an end of said tubular portion body is connected with said suspension edge, while the other end of said tubular portion body is connected with said vibration unit, wherein said frame assembly comprises at least a supporting frame chamber therein, which comprises at least a supporting chamber and at least a vibration chamber, wherein said supporting chamber and said vibration chamber are arranged in an inside and outside overlapping manner, wherein said tubular portion further comprises at least one tubular portion extension and a plurality of tubular portion ribs, wherein said at least one tubular portion extension is perpendicularly extended outwardly from a bottom of said tubular portion body and connected to said suspension edge, wherein two ends of said tubular portion ribs are respectively perpendicularly extended outwardly from an outer side of said tubular portion body and said tubular portion extension, wherein said tubular portion rib is in a right angled triangle shape, wherein one edge of a right angle of said tubular portion rib is arranged on said tubular portion extension, wherein the other edge of the right angle of said tubular portion rib is arranged on an outer side wall of said tubular portion body.

2. An omnidirectional loudspeaker box, comprising a plurality of loudspeaker modules uniformly disposed in an annular configuration, wherein each of said loudspeaker modules comprises at least one active vibration unit and at least one passive vibration unit, which are uniformly disposed in an annular configuration, wherein said at least one active vibration unit is arranged to vibrate in responsive to an input of external signals that drives said at least one passive vibration unit to vibrate together, wherein said active vibration unit comprises:

at least a magnetic coil unit;

at least a voice coil, driven by said magnetic coil unit to reciprocally move;

at least a vibration unit, driven by said voice coil to reciprocally move;

at least a frame assembly;

at least a suspension edge, connected to said vibration unit and said frame assembly; and at least a folding elastic-wave member, connected with said suspension edge, said frame assembly and said vibration unit, wherein said folding elastic-wave member comprises a resilient circular periphery portion connected to said frame assembly and a tubular portion bendingly extended from said circular periphery portion, wherein said tubular portion comprises at least a tubular portion body and at least a tubular portion hole arranged thereon, wherein said tubular portion body is arranged in an annular manner so as to define said tubular portion hole therein, wherein an end of said tubular portion body is connected with said suspension edge, while the other end of said tubular portion body is connected with said vibration unit, wherein said frame assembly comprises at least a supporting frame chamber therein, which comprises at least a supporting chamber and at least a vibration chamber, wherein said supporting chamber and said vibration chamber are arranged in an inside and outside overlapping manner, wherein said tubular portion body further has a plurality of arch shaped inner grooves arranged on top thereof, wherein said inner grooves are spacedly provided on the fringe of a top of said elastic-wave member body.

3. An omnidirectional loudspeaker box, comprising a plurality of loudspeaker modules uniformly disposed in an annular configuration, wherein each of said loudspeaker modules comprises at least one active vibration unit and at least one passive vibration unit, which are uniformly disposed in an annular configuration, wherein said at least one active vibration unit is arranged to vibrate in responsive to an input of external signals that drives said at least one passive vibration unit to vibrate together, wherein said active vibration unit comprises:

at least a magnetic coil unit;

at least a voice coil, driven by said magnetic coil unit to reciprocally move;

at least a vibration unit, driven by said voice coil to reciprocally move, wherein said vibration unit comprises at least a first vibration component and at least a second vibration component, wherein said first vibration component is connected with said second vibration component, wherein said second vibration component comprises at least a second vibration body and at least an annular tubular portion spacing groove arranged on a bottom portion thereof;

at least a frame assembly comprising at least a first support frame, at least a second support frame, and at least a third supporting frame, wherein said second support frame is connected with said first support frame and said third supporting frame;

at least a suspension edge, connected to said vibration unit and said frame assembly; and at least a folding elastic-wave member, connected with said suspension edge, said frame assembly and said vibration unit, wherein said folding elastic-wave member comprises a resilient circular periphery portion connected to said frame assembly and a tubular portion bendingly extended from said circular periphery portion, wherein said first support frame, said suspension edge, said vibration unit, and said tubular portion define and form at least a supporting chamber, wherein said third supporting frame, said circular periphery portion, said tubular portion, and said second support frame define and form at least a vibration chamber, wherein said voice coil and said magnetic coil unit are accommodated in said vibration chamber, wherein said circular periphery portion comprises at least a circular periphery portion body, at least an inner periphery of circular periphery portion, and at least an outer periphery of circular periphery portion, wherein said circular periphery portion body is outwardly and protrudingly extended from said inner periphery of circular periphery portion and said outer periphery of circular periphery portion, wherein said suspension edge comprises at least a suspension edge body, at least an inner periphery of suspension edge, and at least an outer periphery of suspension edge, wherein said suspension edge body is outwardly and protrudingly extended from said inner periphery of suspension edge and said outer periphery of suspension edge, wherein said first support frame comprises at least a first support frame body, which comprises an inner frame portion of first support frame arranged thereon, wherein said outer periphery of suspension edge of said suspension edge is connected to said inner frame portion of first support frame of said first support frame body of said first support frame, wherein said second support frame comprises at least a second support frame body, which comprises an inner frame portion of second support frame arranged thereon, wherein said outer periphery of circular periphery portion of said circular periphery portion is connected to said second support frame inner frame portion of said second support frame body of said second support frame, wherein said tubular portion comprises a tubular portion body and at least a tubular portion extension, perpendicularly and outwardly extended from a bottom of said tubular portion body and connected to said inner periphery of circular periphery portion of said circular periphery portion, wherein at least a peripheral edge of said second vibration body is connected to said suspension edge inner periphery of said suspension edge, wherein a fringe of a top portion of said tubular portion is restricted in said annular tubular portion spacing groove, wherein said first vibration component further comprises at least a first vibration body and at least a reinforcing bar, spacedly arranged on said first vibration body.

4. The omnidirectional loudspeaker box, as recited in claim 3, wherein said active vibration unit further comprises at least an electrical connector, connected to said magnetic coil unit, and at least an electrical terminal, connected with said electrical connector, wherein said electrical connector comprises at least an electrical connector body arranged on a bottom of said frame assembly.

* * * * *